US007960629B2

(12) United States Patent
Sasaki

(10) Patent No.: US 7,960,629 B2
(45) Date of Patent: Jun. 14, 2011

(54) AUTOMATIC PLAYER PIANO EQUIPPED WITH SOFT PEDAL, AUTOMATIC PLAYING SYSTEM AND METHOD USED THEREIN

(75) Inventor: Tomoya Sasaki, Hamamatsu (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 12/720,027

(22) Filed: Mar. 9, 2010

(65) Prior Publication Data

US 2010/0229707 A1 Sep. 16, 2010

(30) Foreign Application Priority Data

Mar. 13, 2009 (JP) ..... 2009-061006

(51) Int. Cl.
*G10F 1/02* (2006.01)

(52) U.S. Cl. ..... 84/21; 84/20

(58) Field of Classification Search ..... 84/20, 21
See application file for complete search history.

(56) References Cited

U.S. PATENT DOCUMENTS 4,450,749 A * 5/1984 Stahnke ..... 84/462
5,131,306 A * 7/1992 Yamamoto ..... 84/19
5,335,574 A * 8/1994 Matsunaga et al. ..... 84/21
5,523,522 A * 6/1996 Koseki et al. ..... 84/21
5,905,220 A * 5/1999 Lee et al. ..... 84/461
6,992,241 B2 * 1/2006 Fujiwara ..... 84/21
7,235,727 B2 * 6/2007 Fujiwara ..... 84/23
7,238,873 B2 * 7/2007 Fujiwara et al. ..... 84/600
7,279,630 B2 * 10/2007 Sasaki et al. ..... 84/723
7,332,670 B2 * 2/2008 Fujiwara et al. ..... 84/744
7,361,828 B2 * 4/2008 Sasaki ..... 84/743
7,405,350 B2 * 7/2008 Sasaki ..... 84/13
7,420,116 B2 * 9/2008 Fujiwara ..... 84/619
7,432,430 B2 * 10/2008 Sasaki ..... 84/462
7,435,895 B2 * 10/2008 Muramatsu ..... 84/741
7,473,841 B2 * 1/2009 Fujiwara ..... 84/615
7,521,626 B2 * 4/2009 Muramatsu ..... 84/719
7,521,627 B2 * 4/2009 Sasaki ..... 84/735
2008/0202322 A1 * 8/2008 Ishii ..... 84/633
2010/0229707 A1 * 9/2010 Sasaki ..... 84/20
2010/0229708 A1 * 9/2010 Komatsu ..... 84/22

* cited by examiner

*Primary Examiner* — Elvin G Enad
*Assistant Examiner* — Robert W Horn
(74) *Attorney, Agent, or Firm* — Harness, Dickey & Pierce, PLC

(57) ABSTRACT

An upright piano is equipped with a soft pedal, and a player makes the hammer stroke shorter by depressing the soft pedal; while a user is reproducing a music tune by means of an automatic player piano fabricated on the basis of the upright piano, the keys are servo controlled on the basis of a position difference of keys between target values and actual values and a key velocity difference, and the duty ratio of driving signal, which is supplied to solenoid-operated key actuators for the keys, are determined on the basis of multiplications between the position difference/key velocity difference and a position gain and a velocity gain; the value of position gain is reduced on the condition that the soft pedal is depressed for preventing the playback from an unintentional loud tone or tones.

20 Claims, 12 Drawing Sheets

| | Target Key Position $0 \leq rx \leq 4$ mm | Target Key Position $4 < rx < 8$ mm | Target Key Position $8$ mm $\leq rx$ |
|---|---|---|---|
| Position Gain kx | 0.3 | 0.3 | 0.15 |
| Velocity Gain kv | 0.3 | 0.5 | 0.6 |
| Fixed Value f | 10% | 9%+(rv-100)/100% | |

| | Target Key Position $0 \leq rx \leq 4$mm | Target Key Position $4 < rx < 8$mm | Target Key Position $8$mm $\leq rx$ |
|---|---|---|---|
| Position Gain kx | 0.5 | 0.3 | 0.15 |
| Velocity Gain kv | 0.4 | 0.5 | 0.6 |
| Fixed Value f | 9%+(rv-100)/100% | | |

AUTOMATIC PLAYER PIANO EQUIPPED WITH SOFT PEDAL, AUTOMATIC PLAYING SYSTEM AND METHOD USED THEREIN

FIELD OF THE INVENTION

This invention relates to an automatic player piano and, more particularly, to an automatic player piano equipped with a soft pedal system for changing original positions of hammers, an automatic playing system incorporated therein and a method for controlling the automatic playing system.

DESCRIPTION OF THE RELATED ART

An automatic player piano is a combination between an acoustic piano and an automatic playing system. A grand piano and an upright piano are available for the automatic player piano, and the black keys, white keys and pedals are selectively depressed and released along a music passage through the automatic playing system for an automatic performance. Pieces of music data are supplied to the automatic playing system for the automatic performance. The pieces of music data express not only the pitch of tones to be produced but also the loudness of the tones. The loudness of the tone is proportional to the velocity of hammer immediately before the collision with the string, i.e., the final hammer velocity. The automatic playing system analyzes the pieces of music data, and determines the back keys and white keys to be depressed and released and the final hammer velocity.

The final hammer velocity is controllable by regulating the key velocity at a reference point to a target value. The key velocity at the reference point is referred to as "a reference key velocity." The reference point is a predetermined key position on a key trajectory of the key from the rest position to the end position, and the key trajectory is a series of values of the key position varied together with time. The series of values of key position toward the end position are referred to "a reference forward key trajectory", and term "a reference backward key trajectory" means a series of values of key position toward the rest position. The reference backward key trajectory is determined for controlling the time at which the tone is decayed.

When a piece of music data expresses a large value of loudness of a tone, the black key or white key for the tone is moved along a steep reference forward key trajectory so as to pass the reference point at a corresponding large value of the reference key velocity. On the other hand, when a piece of music data expresses a small value of loudness of a tone, the automatic playing system makes the black key or white key to travel on a gentle reference forward key trajectory so that the key passes the reference point at a corresponding small value of the reference key velocity. Thus, the automatic playing system controls the loudness of tones by adjusting the reference key velocity to target values.

A typical example of the controlling sequence on the keys is disclosed in Japan Patent Application laid-open No. 2005-292769. As described hereinbefore, the series of values of key position form the reference forward key trajectory. Each value on the reference forward key trajectory is indicative of the target key position, and a target key velocity on the reference forward key trajectory is determinable on the basis of the plural values of the target key position. The prior art automatic playing system includes sensors, which monitor the plungers of solenoid-operated key actuators, and an actual key velocity or an actual key position is determined by on the basis of the detecting signals supplied from the sensors. The actual key position or actual key velocity is also determinable on the basis of a series of values of actual key position or a series of values of actual key velocity. The prior art automatic playing system further includes a servo controller connected to the solenoid-operated key actuators for supplying driving signals, and the actual key velocity and actual key position are compared with the target key velocity and target key position to see whether or not the key surely travels on the reference forward key trajectory. If the difference takes place, the prior art servo controller multiplies the difference by a gain, and determines a duty ratio of the driving signal through the multiplication.

In the prior art servo controller, the gain is variable depending upon the target key position or target key velocity. However, the gain is changed for all of the depressed keys regardless of a step on the pedals. In other words, the gain is always changed on a predetermined point on the reference forward key trajectory.

A pedal system is incorporated in a standard upright piano, and the pedals are known as "a soft pedal" and "a damper pedal." Pianists depress the damper pedal for prolonging the tones. On the other hand, the pianists depress the soft pedal for lessening the loudness of tones. The two sorts of soft medal mechanisms are known. One of the two sorts of soft pedal mechanisms gives rise to lateral shift of the keyboard. The number of wires of the string is lessened through the lateral shift so that the loudness is reduced. The other sort of soft pedal mechanism gives rise to reduction of distance between the original position of hammer and the string, and makes the final hammer velocity reduced.

The other sort of soft pedal mechanism is, by way of example, provided with a hammer rail, which laterally extends in front of the array of hammers, and the soft pedal is linked with the hammer rail. While a player is performing a music passage without pressing down the soft pedal, the hammer rail is spaced from the hammers at the original positions. In this situation, when the player depresses the keys, the hammers fly over the entire distance between the original positions and the strings through the escape from the jacks. On the other hand, when the player presses down the soft pedal, the hammer rail is moved in the rearward direction, and pushes the hammers toward the strings. As a result, the distance to the strings is reduced, and the hammers fly over the reduced distance. The hammers are gently brought into collision with the strings so that the loudness of tones is lessened.

As described hereinbefore, the black keys and white keys are forced to travel on the reference forward key trajectories, and the reference forward key trajectories are determined in such a manner that the keys pass the reference points at the reference key velocity. The hammers are expected to be brought into collision with the strings at target values of the final hammer velocity at target time to produce the tone. However, a problem is encountered in that the hammers are unstable in the automatic performance on the condition that the automatic playing system depresses the soft pedal. For example, the tone is twice produced. Other tones are produced earlier than the target time.

SUMMARY OF THE INVENTION

It is therefore an important object of the present invention to provide an automatic player piano, which reenacts a performance at high fidelity regardless of manipulation on a soft pedal.

It is also an important object of the present invention to provide an automatic playing system, which forms a part of the automatic player piano.

It is another important object of the present invention to provide a method used in the automatic playing system.

The present inventor contemplated the problem inherent in the prior art automatic player piano, and noticed that the hammer butts were spaced from the jacks due to the rearward movement of hammer rail. In this situation, the load on the keys was reduced until the jacks were brought into contact with the hammer butts. The key stroke under the reduced load was of the order of 3 millimeters from the rest positions. However, the servo controller was designed to control the solenoid-operated key actuators on the condition that the load on the keys was unchanged. This resulted in the oscillation of the keys due to the cyclic change of the duty ratio of driving signal. The solenoid-operated key actuators started to push the rear portions of keys on the condition that the duty ratio was increased. The jacks strongly kicked the hammer butts, and the hammers were strongly bought into collision with the strings.

The present invention was made on the basis of the above-described discovery. The present inventor concluded that the servo control on the keys was to be different between the on-state of the soft pedal and the off-state.

To accomplish the objects, the present invention proposes to reduce gains in the servo control on the condition that the soft pedal is depressed.

In accordance with one aspect of the present invention, there is provided an automatic player musical instrument for reproducing tones along a music passage on the basis of music data codes expressing the tones to be produced and a music effect to be imparted to the tones, and the automatic player musical instrument comprises a keyboard musical instrument including plural keys selectively moved for specifying pitch names of the tones to be produced, a tone generating system connected to the plural keys for producing the tones at the pitch names, and forming parts of plural force transmitting paths, each of which has one of the plural keys, an action unit connected to the aforesaid one of the plural keys for transmitting force therethrough and a hammer driven by the action unit for flying over a hammer stroke, and a pedal system having at least one pedal moved between pedal-on state for imparting the music effect to the tones and pedal-off state for eliminating the music effect from the tones, a stroke changer activated so as to change the hammer stroke from a previous value to another value and deactivated so as to change the hammer stroke from the aforesaid another value to the previous value, a pedal linkwork connected between the aforesaid at least one pedal and the stroke changer and transmitting a movement of the aforesaid at least one pedal to the stroke changer for changing the stroke changer between the activation and the deactivation and an automatic playing system including plural actuators respectively provided for the plural force transmitting paths and converting driving signals to force exerted on the force transmitting paths so as to give rise to movements of the force transmitting paths, plural sensors respectively monitoring the plural force transmitting paths and producing detecting signals representative of actual values of physical quantity expressing the movements of the plural force transmitting paths, a pedal controller analyzing the music data codes expressing the music effect and changing the aforesaid at least one pedal between the pedal-on state and the pedal-off state depending upon results of analysis on the music data codes expressing the music effect, at least one pedal state detector monitoring the aforesaid at least one pedal so as to determine pedal state expressing whether the aforesaid at least one pedal stays in the pedal-on state or the pedal-off state, a signal regulator connected to the plural actuators and adjusting the driving signals to target values of a magnitude, a motion controller sequentially supplied with the music data codes expressing the tones and determining target values of the physical quantity for the keys and a servo controller connected to the plural sensors for receiving the actual values of the physical quantity, the aforesaid at least one pedal state detector for receiving the pedal state, the motion controller for receiving the target values of the physical quantity and the signal regulator for supplying pieces of control data expressing the target values of the magnitude and having a comparator comparing each of the target values of the physical quantity with one of the actual values of the physical quantity corresponding to the aforesaid each of the target values so as to determine a difference between the each of the target values and the aforesaid one of the actual values, a magnitude determiner connected between the comparator and the signal regulator and determining the target values of magnitude through a multiplication between the difference and a value of gain for supplying the pieces of control data to the signal regulator and a gain controller connected between the pedal state detector and the magnitude determiner and reducing the value of gain when the aforesaid at least one pedal is in the pedal-on state.

In accordance with another aspect of the present invention, there is provided an automatic playing system provided for an automatic performance expressed by music data codes on a keyboard musical instrument having plural force transmitting paths for producing tones and a pedal system for giving a music effect to the tones through change of a hammer stroke, and the automatic playing system comprises plural actuators respectively provided for the plural force transmitting paths each having a key moved for specifying one of the tones, an action unit transmitting force therethrough and a hammer driven by the action unit for flying over the hammer stroke and converting driving signals to the force exerted on the force transmitting paths so as to give rise to movements of the force transmitting paths, plural sensors respectively monitoring the plural force transmitting paths and producing detecting signals representative of actual values of physical quantity expressing the movements of the plural force transmitting paths, a pedal controller analyzing the music data codes expressing the music effect and changing at least one pedal of the pedal system between the pedal-on state for giving the music effect to the tones and the pedal-off state for removing the music effect from the tones depending upon results of analysis on the music data codes expressing the music effect, at least one pedal state detector monitoring the aforesaid at least one pedal so as to determine pedal state expressing whether the aforesaid at least one pedal stays in the pedal-on state or the pedal-off state, a signal regulator connected to the plural actuators and adjusting the driving signals to target values of a magnitude, a motion controller sequentially supplied with the music data codes and determining target values of the physical quantity for the keys and a servo controller connected to the plural sensors for receiving the actual values of the physical quantity, the aforesaid at least one pedal state detector for receiving the pedal state, the motion controller for receiving the target values of the physical quantity and the signal regulator for supplying pieces of control data expressing the target values of the magnitude and having a comparator comparing each of the target values of the physical quantity with one of the actual values of the physical quantity corresponding to the aforesaid each of the target values so as to determine a difference between the aforesaid each of the target values and the aforesaid one of the actual values, a magnitude determiner connected between the comparator and the signal regulator and determining the target values of magnitude through a multiplication between the difference and a value of gain for supplying the pieces of control data to the signal regulator and a gain controller connected between the pedal state detector and the magnitude determiner and reducing the value of gain when the aforesaid at least one pedal is in the pedal-on state.

In accordance with yet another aspect of the present invention, there is provided a method controlling an automatic player musical instrument for an automatic performance comprising the steps of a) acquiring an actual value of physical quantity expressing a real movement of a key of a keyboard musical instrument for producing a tone, a target value of the physical quantity expressing an expected movement of the key and a piece of state data expressing whether or not a pedal for imparting a music effect to the tones is changed between pedal-on state and pedal-off state, b) determining whether a gain is to have a reduced value or a non-reduced value on the basis of the piece of state data and the physical quantity and a difference between the actual value of the physical quantity and the target value of the physical quantity, c) determining a target value of a magnitude of a driving signal through a multiplication between the difference and one of the reduced value and non-reduced value, d) adjusting the driving signal to the target value of the magnitude, e) supplying the driving signal to an actuator provided for the key so as to give rise to the real movement and f) repeating the steps a) to e) until the key completes the real movements.

BRIEF DESCRIPTION OF THE DRAWINGS

The features and advantages of the automatic player piano, automatic playing system and method will be more clearly understood from the following description taken in conjunction with the accompanying drawings, in which.

DESCRIPTION OF THE PREFERRED EMBODIMENTS

Figure 1:
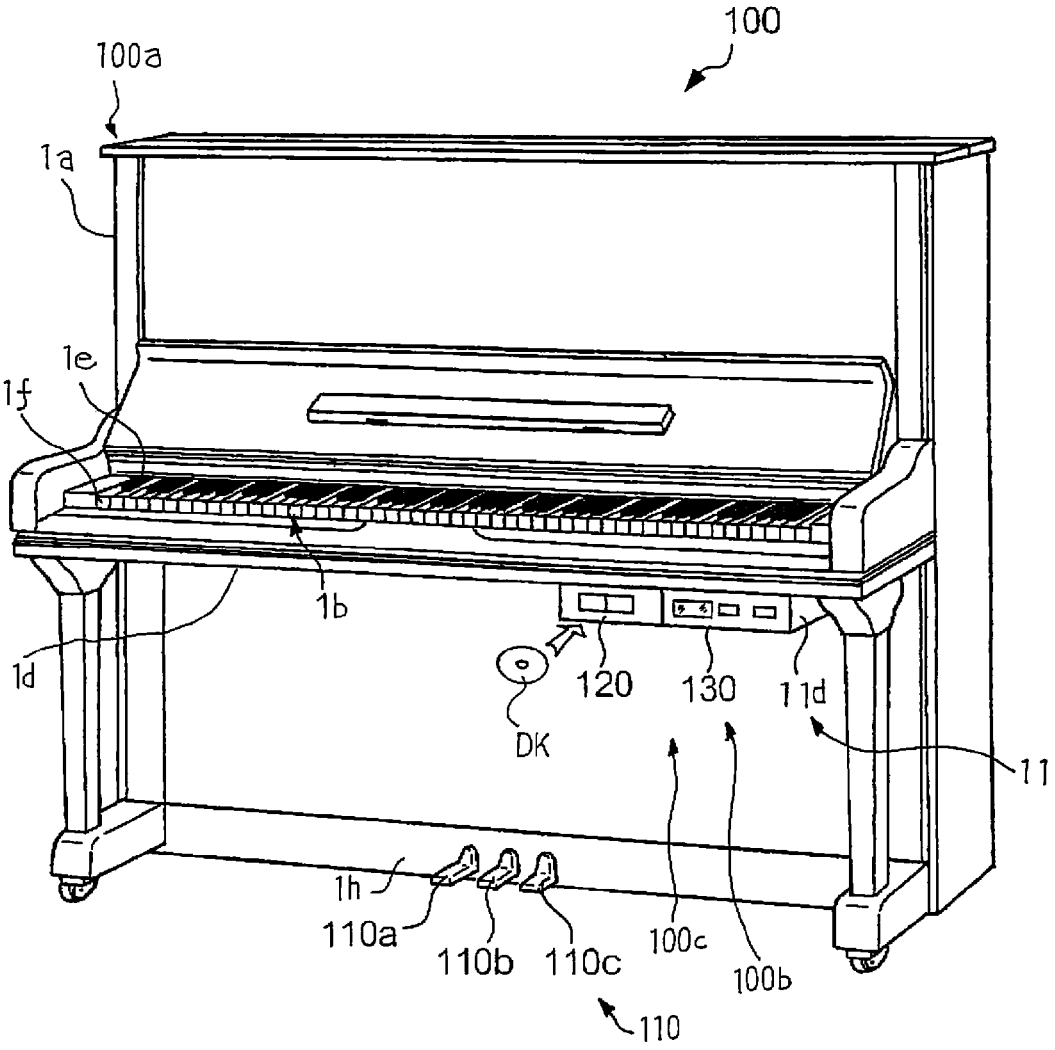
FIG. 1 is a perspective view showing the external appearance of an automatic player piano of the present invention.

An automatic player musical instrument embodying the present invention largely comprises a keyboard musical instrument and an automatic playing system. The automatic playing system performs a music passage on the keyboard musical instrument on the basis of music data codes expressing tones to be produced and a music effect to be imparted to the tones.

The keyboard musical instrument includes plural keys, a tone generating system and a pedal system, and the plural keys and pedal system are connected to the tone generating system. In detail, the keys are selectively moved for specifying pitch names of the tones to be produced, and the tone generating system responds to the movements of the keys so as to produce the tones at the specified pitch names. The tone generating system forms parts of plural force transmitting paths.

Each of the force transmitting paths has one of the plural keys, an action unit and a hammer. The plural keys are respectively connected to the action units. Each of the action units transmits force to the hammers associated thereto so that the hammer is driven for flying over a hammer stroke.

The pedal system has at least one pedal, a pedal linkwork and a stroke changer. The pedal is connected through the pedal linkwork to the stroke changer, and is moved between pedal-on state and pedal-off state. The movement of pedal is transmitted through the pedal linkwork to the stroke changer. When the pedal is changed to the pedal-on state, the hammer stroke is reduced from a previous value to another value, and the music effect is imparted to the tones. On the other hand, when the pedal is changed to the pedal-off state, the pedal stroke is recovered to the previous value, and the music effect is eliminated from the tones. Thus, the music effect is imparted to or eliminated from the tones depending upon the activation/deactivation of stroke changer.

The automatic playing system includes plural actuators, plural sensors, a pedal controller, a pedal state detector, a signal regulator, a motion controller and a servo controller, and the plural keys and pedal system are controlled in cooperation among the actuators, sensors, pedal controller, pedal state detector, signal regulator, motion controller and servo controller.

The plural actuators are respectively provided for the plural force transmitting paths, and converts driving signals to force exerted on the force transmitting paths. While the actuators are exerting the force on the force transmitting paths associated with the actuators, the movements of force transmitting paths are given rise to. The pedal controller analyzes the music data codes expressing the music effect, and changes the pedal between the pedal-on state and the pedal-off state depending upon results of analysis on the music data codes expressing the music effect. Thus, the automatic playing system gives rise to the movements of force transmitting paths and the movements of stroke changer without any fingering and any pedaling of a human player.

The sensors respectively monitor the plural force transmitting paths, and produce detecting signals representative of actual values of physical quantity. The actual values of physical quantity express the movements of the plural force transmitting paths. The pedal state detector monitors the pedal so as to determine pedal state expressing whether the pedal stays in the pedal-on state or the pedal-off state. Thus, the movements of keys and the movement of pedal are reported to the servo controller.

The signal regulator is connected to the plural actuators, and adjusts the driving signals to target values of a magnitude. The force on the force transmitting paths is proportionally varied together with the magnitude. For this reason, the force, which is exerted on the force transmitting paths, is controllable. The motion controller and servo controller participate in the control sequence on the actuators. The control sequence is hereinafter described in detail.

The motion controller is sequentially supplied with the music data codes expressing the tones, and determines target values of the physical quantity for the keys. The servo controller is connected to the plural sensors for receiving the actual values of the physical quantity, pedal state detector for receiving the pedal state, motion controller for receiving the target values of the physical quantity, and is further connected to the signal regulator for supplying pieces of control data expressing the target values of the magnitude. The servo controller has a comparator, a magnitude determiner and a gain controller.

The comparator compares each of the target values of the physical quantity with one of the actual values of the physical quantity corresponding to the aforesaid each of the target values so as to determine a difference between the each of the target values and the aforesaid one of the actual values. The magnitude determiner is connected between the comparator and the signal regulator, and determines the target values of magnitude through a multiplication between the difference and a value of gain for supplying the pieces of control data to the signal regulator. The gain controller is connected between the pedal state detector and the magnitude determiner, and reduces the value of gain when the pedal is in the pedal-on state. For this reason, the magnitude of driving signals on the condition of pedal-on state are less than the magnitude of driving signals on the condition of pedal-off state.

While the stroke changer makes the pedal stroke reduced, gap takes place between the action units and the hammers, and the inertial load on the actuators is decreased rather than that in the pedal-off state. In this situation, the magnitude of driving signals is decreased together with the inertial load. Thus, the force on the force transmitting paths is properly controlled. As a result, the tones are produced at optimum loudness.

The automatic player musical instrument is controlled for an automatic performance through a method, and the method comprises six steps. In the first step, an automatic playing system acquires an actual value of physical quantity expressing a real movement of a key of the keyboard musical instrument for producing a tone, a target value of the physical quantity expressing an expected movement of the key and a piece of state data expressing whether or not a pedal for imparting a music effect to the tones is changed between pedal-on state and pedal-off state.

In the second step, the automatic playing system determines whether a gain is to have a reduced value or a non-reduced value on the basis of the piece of state data and physical quantity and a difference between the actual value of the physical quantity and the target value of the physical quantity. In the third step, the automatic playing system determines a target value of a magnitude of a driving signal through a multiplication between the difference and one of the reduced value and non-reduced value.

In the fourth step, the automatic playing system adjusts the driving signal to the target value of the magnitude. In the fifth step, the driving signal is supplied to an actuator provided for the key so as to give rise to the real movement. In the sixth step, the automatic playing system repeats the above-described five steps until the key completes the real movements.

In the following description, term "front" is indicative of a position closer to a player who is sitting for fingering, than a position modified with term "rear". A line drawn between a front position and a corresponding rear position extends in a "fore-and-aft direction", and a lateral direction crosses the fore-and-aft direction at right angle.

First Embodiment

Referring first to FIG. 1 of the drawings, an automatic player musical instrument 100 largely comprises an upright piano 100*a*, an automatic playing system 100*b* and a recording system 100*c*. As described hereinlater in detail, the upright piano 100*a* is similar in structure to a standard upright piano so that a human player performs music passages on the upright piano 100*a* through fingering and pedaling.

The automatic playing system 100*b* is a sort of computer architecture, and is personified as "an automatic player". The automatic playing system 100*b* has an information processing capability, and a computer program runs on an information processor of the automatic playing system 100*b*. The automatic playing system 100*b* performs the music passages on the upright piano 100*a* instead of the fingering of the human player. The music passages are expressed by sets of music data codes, and a set of music data codes is loaded into the automatic playing system for the automatic performance. The music data codes are sequentially analyzed so as to determine the tones to be produced through the fingering and effects to be imparted to the tones through the pedaling. The automatic playing system 100*b* fingers and pedals on the upright piano 100*a* on the basis of the results of analysis so as to perform the music passage through the upright piano 100*a*. In this instance, the music data codes are assumed to be prepared in accordance with the MIDI (Musical Instrument Digital Interface) protocols.

The recording system 100*c* is also a computer architecture, and has an information processing capability. Most of the system components of the automatic playing system 100*b* are shared with the recording system 100*c* as will be described hereinlater in detail. Another computer program runs on the information processor for recording performances on the upright piano 100*a*, and produces sets of the music data codes expressing the performances.

Structure and Behavior of Upright Piano

The upright piano 100*a* includes a piano cabinet 1*a*, a key board 1*b*, a mechanical tone generating system 1*c* (see FIG. 2) and a pedal system 110. The piano cabinet 1*a* has a key bed 1*d*, which horizontally projects, and the key board 1*b* is mounted on the key bed 1*d*. Plural black keys 1*e* and plural white keys 1*f* are incorporated in the keyboard 1*b*, and are independently moved between rest positions and end positions. In this instance, the end positions are spaced from the rest position by about 10 millimeters.

The black keys 1*e* and white keys 1*f* are laid on the well known pattern. The black keys 1*e* and white keys 1*f* are depressed and released for a note-on key event, i.e., generation of a tone and a note-off key event, i.e., decay of the tone. A balance rail BR extends in the lateral direction on the key bed 1*d*, and the black keys 1*e* and white keys 1*f* are held in contact with the balance rail BR at intermediate positions thereof. Balance pins P upwardly project from the balance rail BR at intervals, and offer fulcrums to the keys 1*e* and 1*f*, respectively. In the following description, the terms "front portions" and "rear portions" are determined with respect to the balance rail BR. When a human player depresses the front portions of keys 1*e* and 1*f*, or when the automatic player pushes up the rear portions of keys 1*e* and 1*f*, the keys 1*e* and 1*f* start to travel from the rest positions to the end positions. On the other hand, the human player and automatic player remove the force from the front portions of keys 1*e* and 1*f* and the rear portions of keys 1*e* and 1*f*, the keys 1*e* and 1*f* start to travel toward the rest positions.

In the following description, term "depressed key" means the black key 1*e* or white key 1*f*, which starts to travel toward the end position, and term "released key" means the black key 1*e* or white key 1*f*, which starts to travel toward the rest position.

The pitch names of a scale are respectively assigned to the keys 1*e* and 1*f* so that the human player and automatic player specify the tones to be produced through the keys 1*e* and 1*f*. Key numbers are assigned to the pitch names, respectively so that each of the black keys 1*e* and white keys 1*f* is specified with a key code expressing the key number. Capstan buttons CB project from the rear portions of keys 1*e* and 1*f*, and the movements of keys 1*e* and 1*f* are transmitted from the capstan buttons CB to the tone generating mechanism 1*c* for specifying the pitch of tones.

An inner space is defined in the cabinet 1*a*, and the mechanical tone generating system 1*c* and the pedal system 110 except for three pedals 110*a*, 110*b* and 110*c* are provided inside the cabinet 1*a*. The three pedals 110*a*, 110*b* and 110*c* projects from a lower portion of the piano cabinet 1*a*, and are named as "soft pedal", "muffler pedal" and "damper pedal", respectively. The soft pedal 110*a*, muffler pedal 110*b* and damper pedal 110*c* are selectively depressed by a human player or the automatic player so as to impart artificial expression to the tones through a soft pedal linkwork 110*d*, a muffler pedal linkwork 110*e* and a damper pedal linkwork 110*f*.

The pedal system 110 is connected to the mechanical tone generating system 1*c* so that the movements of soft muffler and damper pedals 110*a*, 110*b* and 110*c* are transmitted to the mechanical tone generating system 1*c* for imparting the effects to the tones.

The mechanical tone generating system 1*c* includes action units 2, hammer assemblies 3, strings 4 and damper assemblies 6. The action units 2 are respectively connected to the keys 1*e* and 1*f* so that the depressed keys 1*e* and 1*f* actuate the associated action units 2. The actuated action units 2 are moved from original positions thereof. The hammer assemblies 3 are respectively connected to the action units 2, and the damper assemblies 6 are also connected to the action units 2, respectively. The actuated action units 2 cause the associated damper assemblies 6 spaced from the associated strings 4 so that the strings 4 get ready for vibrations. The actuated action units 2 further drive the associated hammer assemblies 3 for rotation, and the hammer assemblies 3 are brought into collision with the strings 4 so as to give rise to the vibrations of strings 4. Thus, the action units 2, hammer assemblies 3, damper assemblies 6 and strings 4 cooperate with one another for generating the tones, and serve as the mechanical tone generating system 1*c*.

In the following description, term "original position" means a position of the component part of the mechanical tone generating system 1*c* while the associated key 1*e* or 12*f* is staying at the rest position.

The action units 2 are arranged in the lateral direction over the rear portions of keys 1*e* and 1*f*, and the capstan buttons CB of keys 1*e* and 1*f* are respectively held in contact with the action units 2. The action units 2 are rotatably supported by a center rail CR, which in tern is supported by action brackets (not shown) on the key bed 1*d*. The depressed keys 1*e* and 1*f* give rise to rotation of the action units 2 in a direction indicated by an arrow AR1. When the force is removed from the depressed keys 1*e* and 1*f*, the action units 2 are permitted to move toward the original positions due to the self-weight thereof, and is rotated in the direction opposite to the arrow AR1.

Each of the action units 2 has a jack 2*a*, a whippen assembly 2*b* and a regulating button 2*c*. The whippen assembly 2*b* is rotatably supported by a center rail CR, and the jack 2*a* is rotatably supported by the whippen assembly 2*b*. The regulating button 2*c* is supported by the center rail CR, and the jack 2*a* has a toe opposed to the regulating button 2*c*.

When the toe of jack 2*a* is brought into contact with the regulating button 2*c*, the jack 2*a* is rotated on the whippen assembly 2*b*, and drives the associated hammer assembly 3 for rotation in a direction indicated by an arrow AR2 through escape from the associated hammer assembly 3. The jack 2*a* further has a leg portion, which upwardly projects from the axis of rotation of the jack 2*a*.

While the action units 2 is staying at the original positions, the upper surfaces of the jacks 2*a* are held in contact with the associated hammer assemblies 3. When the jack 2*a* is driven for rotation on the whippen assembly 2*b* through the contact with the regulating button 2*c*, the leg portion of jack 2*a* kicks the associated hammer assembly 3 so as to give rise to the rotation toward the string 4.

The strings 4 are designed to generate the tones at the pitch names of the scale, respectively, and the pitch names are identical with the pitch names respectively assigned to the keys 1*e* and 1*f*. For this reason, the pitch names of tones to be produced are specified by means of the keys 1*e* and 1*f*. The strings 4 are stretched over a frame of the piano cabinet 1*a*.

The hammer assemblies 3 are also arranged in the lateral direction over the action units 2, and are rotatably supported by the center rail CR. Each of the hammer assemblies 3 is broken down into a hammer butt 3*a*, a hammer shank 3*b* and a hammer head 3*c*. The hammer butt 3*a* is rotatably connected to the center rail CR, and the hammer shank 3*b* upwardly frontwardly projects from the hammer butt 3*a*. The hammer head 3*c* is connected to the upper end portion of the hammer shank 3*b*, and projects toward the string 4.

While the black keys 1*e* and white keys 1*f* are staying at the rest positions, the action units 2 and hammer assemblies 3 are in the original positions thereof, and the hammer shanks 3*b* are rest on a hammer rail 110*h*, which forms a part of the soft pedal linkwork 110*d*. When the black key 1*e* or white key 1*f* starts to travel toward the end position, the depressed key 1*e* or 1*f* gives rise to the rotation of action unit 2 in the direction indicated by the arrow AR1, and the jack 2*a* starts to pushes the hammer butt 3*a* so as forcibly to rotate the associated hammer assembly 3 in the direction indicated by arrow AR2. The toe of jack 2*a* is getting closer and closer to the regulating button 2*c*. The toe is brought into contact with the regulating button 2*c*, and the jack 2*a* escapes from the hammer butt 3*a*. Then, the hammer assembly 3 starts the free rotation toward the string 4. The hammer head 3*c* is brought into collision with the string 4 at the end of free rotation, and the string 4 generates the tone through the vibrations thereof.

The hammer assembly 3 rebounds on the string 4, and a catcher of the hammer assembly 3 is received by a back check of the action unit 2. When the depressed key 1*e* or 1*f* is released, the action unit 3 returns to the original position, and the hammer shank 3*b* is brought into contact with the rear surface of the hammer rail 110*h*.

The damper assemblies 6 are arranged in the lateral direction at the back of the hammer assemblies 3. Each of the damper assemblies includes a force transmission mechanism 6*a* and a damper head 6*b*. The force transmission mechanism 6*a* is rotatably supported by the center rail CR, and the damper head 6*b* is connected to an upper end of the force transmission mechanism 6*a*. The force transmission mechanism 6*a* is urged in the counter clockwise direction at all times. For this reason, while the black key 1*e* or white key 1*f* is staying at the rest position without pressing down the damper pedal 110*c*, the damper head 6*b* is held in contact with the string 4, and prevents the string 4 from vibrations through resonance.

While the key 1*e* or 1*f* is traveling from the rest position toward the end position, the force transmission mechanism 6*a* transfers the force from the depressed key 1*e* or 1*f* to the damper head 6*b*, and the damper head 6*b* is spaced from the string 4. Then, the string 4 gets ready to vibrate. When the depressed key 1*e* or 1*f* is released, the damper head 6*b* is brought into contact with the string 4 on the way toward the rest position, and makes the vibrations decayed.

As described hereinbefore, the pedal system 110 has the three pedals 110*a*, 110*b* and 110*c* and three pedal linkworks 110*d*, 110*e* and 110*f*, and the hammer rail 110*h* forms a part of the soft pedal linkwork 110*d*. The damper pedal linkwork 110*e* and muffler pedal linkwork 110*f* are similar to those of a standard upright piano, and are well known to the persons skilled in the art. When the damper pedal 100*c* is depressed, the damper pedal linkwork 110*f* keeps the damper heads 6*b* spaced from the strings 4 after the release of keys 1*e* and 1*f* so that the tones are prolonged. When the muffler pedal 110*b* is depressed, the muffler pedal linkwork 110*e* makes a sheet of felt (not shown) moved between the hammer assemblies 3 and the strings 4. In this situation, when the hammer heads 3*c* fly toward the strings 4, the hammer heads 3*c* are brought into collision with the strings 4 through the sheet of felt so as to make the tones faintly generated. Although the soft pedal linkwork 110*d* is also similar to that of the standard upright piano, the soft pedal linkwork 110*d* is described in detail for better understanding of the present invention.

The hammer rail 110*h* laterally extends in front of the array of hammer assemblies 3, and the soft pedal 110*a* is connected to the hammer rail 110*h* through the remaining links of the soft pedal linkwork 110*d*. The hammer rail 110*h* is rotatably supported by the action brackets (not shown), and is rotated in a direction indicated by an arrow AR3 and the opposite direction of arrow AR3.

Figure 2:
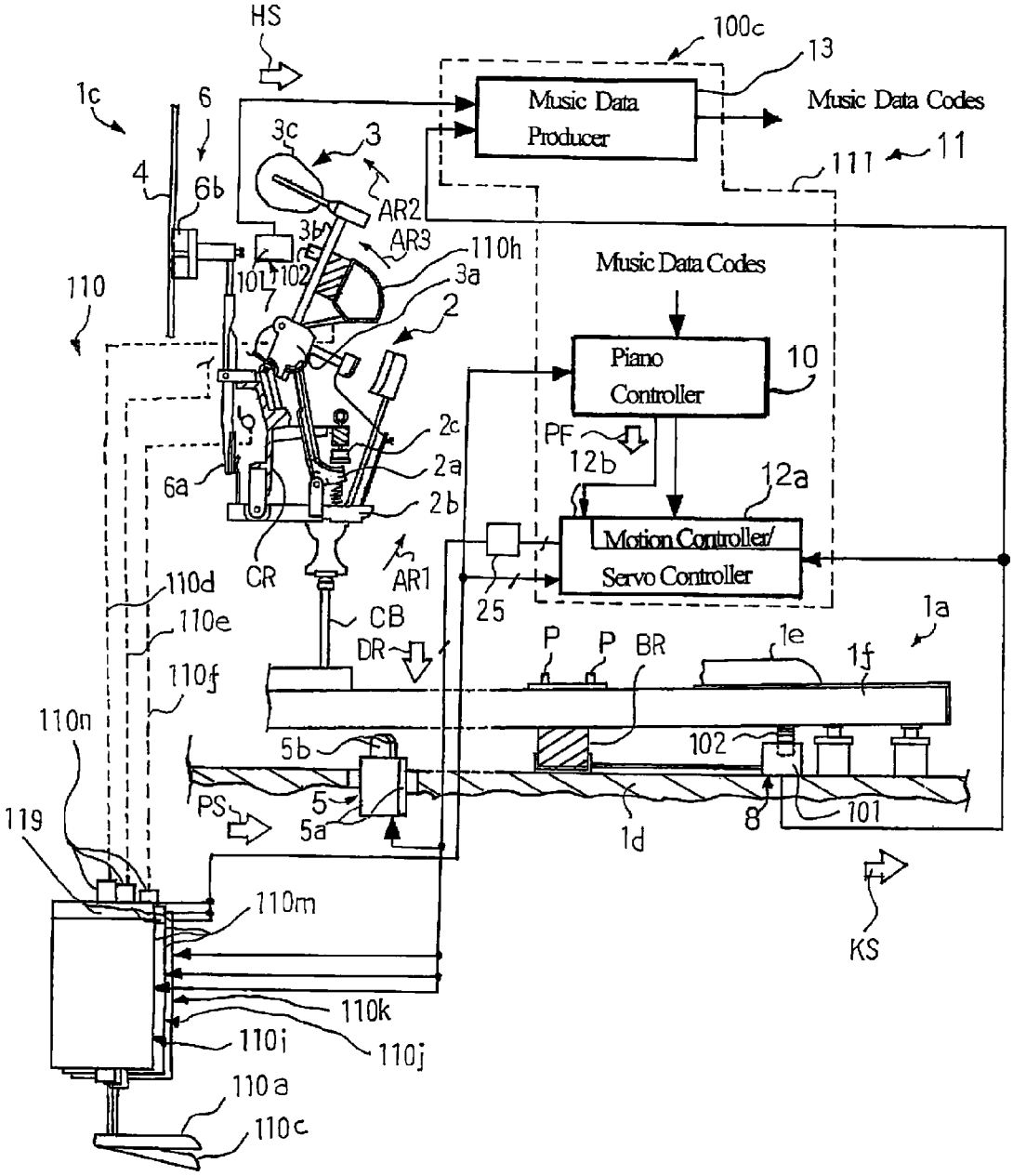
FIG. 2 is a cross sectional side view showing the structure of a mechanical tone generating system incorporated in an upright piano of the automatic player piano.

While the soft pedal 110*a* is resting at the original position, the hammer rail 110*h* is found at an original position shown in FIG. 2, and the hammer shanks 3*b* of all the hammer assemblies 3 are held in contact with the hammer rail 110*h*. In this situation, when the black keys 1*e* and white keys 1*f* are depressed, the depressed keys 1*e* and 1*f* make the associated jacks 2*a* escape from the hammer assemblies 3. The hammer assemblies 3 fly over whole hammer trajectories or full hammer strokes from the hammer rail 110*h* at the original position to the strings 4, and the hammer heads 3*c* are brought into collision with the strings 4. The hammer assemblies 3 rebound on the strings 4, and are rotated in the direction opposite to the arrow AR2. The catchers of hammer assemblies 3 are captured by the back checks of action units 2. When the depressed keys 1*e* and 1*f* are released, the action units 2 and hammer assemblies are permitted to rotate in the direction opposite to arrow AR1 and in the direction opposite to arrow AR2, and the hammer shanks 3*b* are brought into contact with the hammer rail 110*h*, again.

When the soft pedal 110*a* is pressed down, the soft pedal 110*a* give rise to the rotation of hammer rail 110*h* in the direction indicated by the arrow AR3 through the links of soft pedal linkwork 110*d* so that the distance between the hammer rail 110*h* and the strings 4 is reduced. In this situation, the hammer assemblies 3 are forcibly moved to predetermined positions on the way to the strings 4. When the depressed keys 1*e* and 1*f* give rise to the escape of jacks 2*a* from the hammer assemblies 3, the hammer assemblies 3 fly over parts of the hammer trajectories, and the hammer heads 3*c* are softly brought into collision with the strings 4. As a result, the loudness of tones is lessened. Thus, the reduction in loudness is the effect to be imparted to the tones through the soft pedal 110*a* and soft pedal linkwork 110*d*.

While the key 1*e* or 1*f* is traveling from the rest position under the condition that the soft pedal 100*a* is not depressed, the depressed key 1*e* or 1*f* makes the action unit 2 disconnected from the hammer assembly 3, i.e., let off at a hammer position spaced from the string 4 by 2 to 3 millimeters, and, thereafter, the hammer 3 is brought into collision with the string 4 at the end of free rotation. In case where a tones is to be repeatedly generated at small loudness at high speed, this behavior is causative of a missing tone, which is called as "misstouch". In order to prevent the player from the miss-touch, the soft pedal 110*a* is effective against the miss-touch. When the soft pedal 110*a* is depressed in the high-speed repetition, the hammer rail 110*h* pushes the hammer assemblies 3 in the rearward direction. As a result, the hammer stroke is reduced. The reduced hammer stroke makes the hammer assemblies 3 promptly to respond to the high-speed repetition.

System Configuration of Automatic Playing System

The automatic playing system 100*b* comprises an array of key sensors 8, a controller 11, an array of solenoid-operated key actuators 5, solenoid-operated pedal actuators 110*i*, 110*j* and 110*k*, a disk driver 120 (see FIG. 1) and a manipulating panel 130 (see FIG. 1). The controller 11 is hung from the key bed 1*d* as shown in FIG. 1. The disk driver 120 and manipulating panel 130 are accommodated in a casing 11*d* of the controller 11, and are exposed to a front panel of the casing 11*d*. A human player loads a disk plate DK such as, for example, a DVD (Digital Versatile Disk) or a CD (Compact Disk) into the disk driver 120, and changes the disk plate DK to another disk plate. In this instance, standard MIDI files are stored in the disk plate DK.

The manipulating panel 130 includes a touch screen. The touch screen is a combination between a visual image reproducing device such as, for example, a liquid crystal display panel and a detector overlapped with a screen of the visual image reproducing device. The liquid crystal display panel produces various visual images such as, messages, lists, switches and levers on the screen with the assistance of the controller 11. When a user brings the finer into contact with an area of the screen, the detector reports the location of the area to the controller 11, and the controller 11 determines the visual image produced in the area. If the visual image expresses jobs in several areas on the screen, the controller 11 specifies the job instructed by the user. The human player further pushes and moves the visual images expressing the switches and levers on the screen so as to give user's instructions, user's options and user's selection to the automatic playing system 100*b*. Thus, the manipulating panel 130 serves as a man-machine interface.

Figure 3:
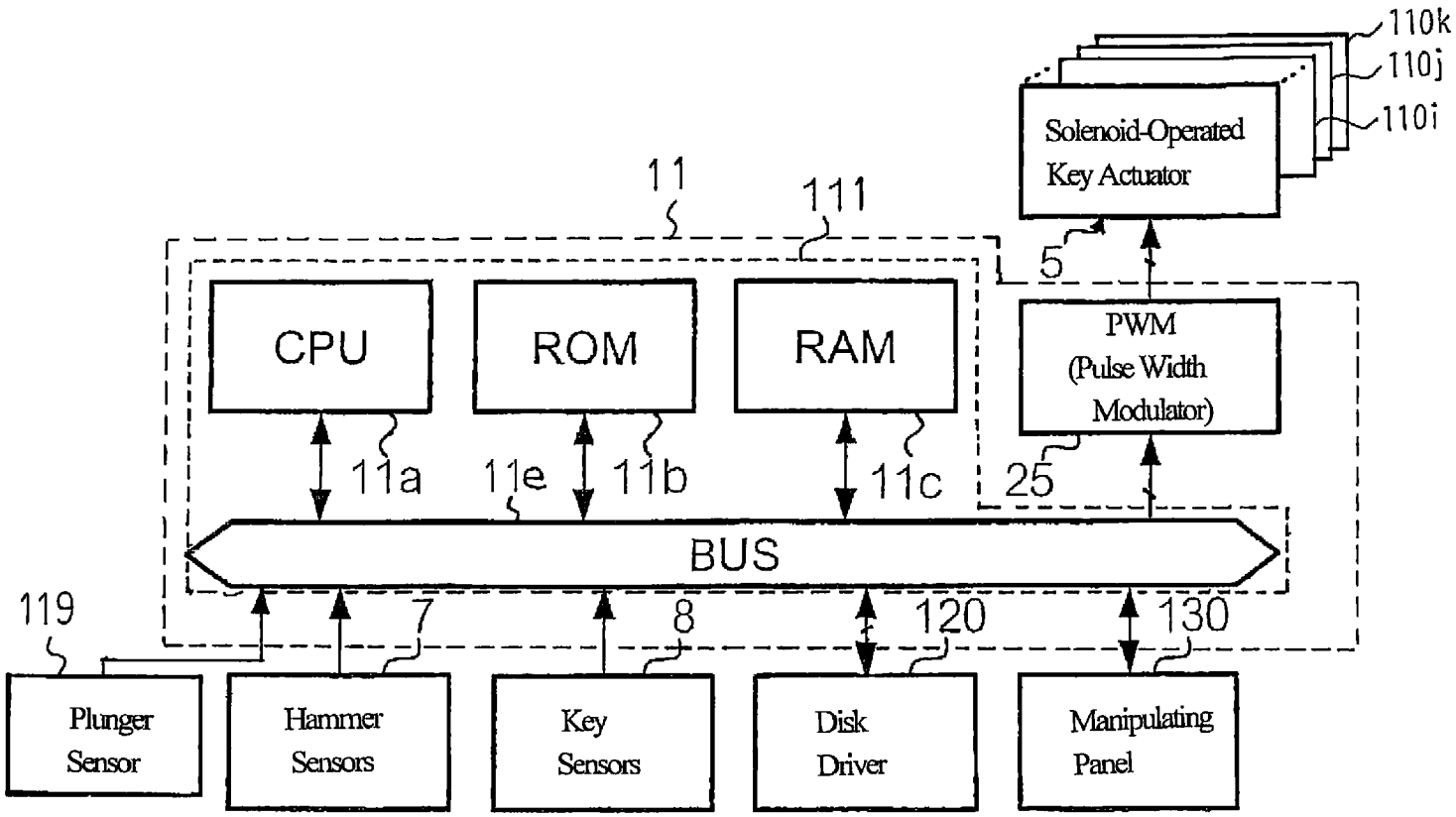
FIG. 3 is a block diagram showing the system configuration of an information processing system and the electric connection between the information processing system and other system components.

Turning to FIG. 3 of the drawings, the controller 11 includes an information processing system 111 and a pulse width modulator 25, which is abbreviated as "PWM", and the information processing system 111 and pulse width modulator 25 are accommodated in the casing 11*d*.

The information processing system 111 includes a central processing unit 11*a*, peripheral processors (not shown), a read only memory device 11*b*, which is abbreviated as "ROM", a random access memory device 11*c*, which is abbreviated as "RAM", a shared bus system 11*e*, which is abbreviated as "BUS", internal clocks (not shown) and signal interfaces (not shown). The central processing unit 11*a*, peripheral processors, read only memory device 11*b*, random access memory device 11*c* and signal interfaces are connected to the shared bus system 11*e* so that the central processing unit 11*a* is communicable with the peripheral processors, read only memory device 11*b*, random access memory device 11*c* and signal interfaces through the shared bus system 11*e*.

The central processing unit 11*a* is an origin of the information processing capability, and a computer program runs on the central processing unit 11*a* so as to achieve jobs expressed by the computer program. The central processing unit 11*a* is supported by the peripheral processors such as a direct memory access processor.

A part of the read only memory device 11*b* is implemented by semiconductor flash memory devices. Various sorts of information are stored in the read only memory device 11*b* in the non-volatile manner. However, the data stored in the semiconductor flash memory are rewritable. A set of instruction codes, which forms the computer program, is one of the various sorts of information, and a subroutine program is designed for the automatic performance. Sets of music codes may be stored in the semiconductor flash memory. Look-up tables defines the values of hammer position signals and the hammer positions and the values of key position signals and the key positions, and are stored in the semiconductor flash memory devices. Plural gain tables are further stored in the read only memory devices 11*b*, and the computer program and plural gain tables will be hereinlater described in detail.

The random access memory device 11*c* serves as a working memory, and the pieces of key position data, pieces of hammer position data and pieces of plunger velocity data are stored in data tables created in the random access memory devices 11*c* in a rewritable manner. A memory location is assigned to each of the keys 1*e* and 1*f* in the data table for keys, and a predetermined number of pieces of key position data are stored in the memory location in a first-in first-out manner. Similarly, a memory location is assigned to each of the hammers 3 in the data table for hammers, and a predetermined number of pieces of hammer position data are stored in the memory location in a first-in first-out manner. Pieces of music data, which are expressed by the music data codes, pieces of driving data, which express the amount of mean current or a duty ratio of the driving signal DR, and calculation results are further stored in the random access memory devices 11*c*. The amount of mean current is stored for each of the solenoid-operated key actuators 5 and solenoid-operated pedal actuators 110*i*, 110*j* and 110*k*. In case where the computer program is downloaded from a program source through a communication network, the computer program is temporarily stored in the random access memory 11*c*.

The signal interfaces (not shown) are connected to the pulse width modulator 25 and sensors of the automatic playing system 100*b* and recording system 100*c*. The signal interfaces assigned to the sensors include analog-to-digital converters, one of which is labeled with reference numeral 24 in FIG. 6, and data buffers, and analog output signals of the sensors are converted to digital data signals. The digital signals are temporarily stored in the data buffers, and the central processing unit 11*a* periodically transfers the digital data signals to the data tables in the random access memory device 11*c* through another subroutine program of the computer program.

One of the internal clocks measures a lapse of time from the initiation of automatic performance or a lapse of time from the initiation of recording. The internal clocks may be implemented by software. In case where the software clocks are employed, the internal clocks are realized in the random access memory 11*c*.

Turning back to FIG. 2 of the drawings, the key sensors 8 are connected in parallel to the signal interface of the information processing system 111, and are respectively provided for the keys 1*e* and 1*f* for reporting actual key positions of the associated keys 1*e* and 1*f* to the controller 11. Pieces of key position data, which express the actual key positions, are used in a servo control on the keys 1*e* and 1*f* as will be hereinlater described in detail.

Figure 4A:
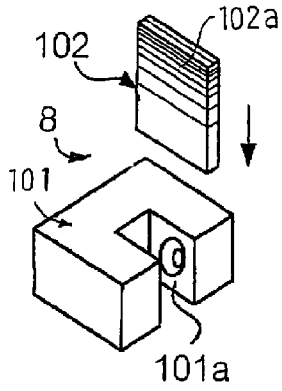
FIG. 4A is a perspective view showing component elements of a key sensor.
Figure 4B:
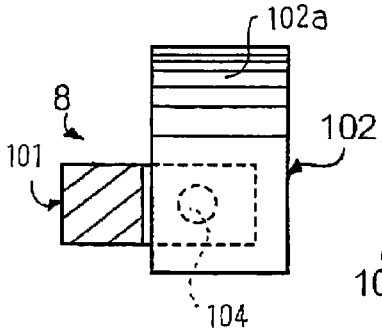
FIG. 4B is a cross sectional side view showing a gray scale printed on a photo modulator of the key sensor.
Figure 4C:
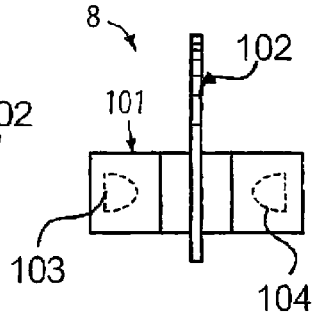
FIG. 4C is a front view showing a relative position between the photo modulator and a photo coupler.

FIG. 4A to 4C show one of the key sensors 8. A photo coupler 101 and a photo modulator 102 form in combination the key sensor 8. The photo coupler 101 is provided on the key bed 1*d*, and the photo modulator 102 is hung from the lower surface of the front portion of associated key 1*e* or 1*f*. The photo coupler 101 serves as a photo interrupter, which has a light emitting element 104 such as, for example, a semiconductor light emitting diode and a light detecting element 103 such as, for example, a semiconductor photo transistor. The light emitting element 104 produces light from electric current, and the light detecting element 103 converts incident light to electric current. The light emitting element 104 and light detecting element 103 are spaced from one another in a housing 101*a*, and a light beam is created between the light emitting element 104 and the light detecting element 103 across a trajectory of the photo modulator 102. A gray scale 102*a* is printed on major surfaces of the photo modulator 102, and makes the transmittance of photo modulator 102 gradually varied in a direction in which the trajectory of photo modulator 102 extends. For this reason, while the key 1*e* or 1*f* is traveling from the rest position to the end position, the photo modulator 102 is moved on the trajectory together with the key 1*e* or 1*f*, and makes the amount of light on the light detecting element 103 varied depending upon the current key position. The light detecting element converts the incident light to the electric current, the amount of which is dependent on the amount of incident light. Thus, the current key position is converted to the amount of electric current, and the key position signal KS is produced from the electric current. The entire loci of keys 1*e* and 1*f* are fallen within the cross section of light beams so that the information processing system 111 can determine the current key positions on the basis of the pieces of key position data represented by the key position signals KS.

Turning back to FIG. 2, the controller 11 is further connected in parallel to the solenoid-operated key actuators 5 and solenoid-operated pedal actuators 110*i* to 110*k*. Driving signals DR are selectively supplied from the controller 11 to the solenoid-operated key actuators 5 and solenoid-operated pedal actuators 110*i*, 110*j* and 110*k* so as to give rise to the movements of keys 1*e* and 1*f* and the movements of pedals

110*a*, 110*b* and 110*c*. In detail, the information processing system 111 determines the amount of current of driving signals DR, and supplies the data codes expressing the amount of current of driving signals to the pulse width modulator 25. The driving signal DR is implemented by a pulse train so that the pulse width modulator 25 adjusts the amount of mean current to a target value by optimizing the duty ratio of the pulse train. The amount of mean current is variable in the movements of keys 1*e* and 1*f* so as to force the keys 1*e* and 1*f* to travel on the reference key trajectories as will be hereinafter described in detail.

The array of solenoid-operated key actuators 5 is hung from the key bed 1*d* in the cabinet 1*a*, and is arranged in the lateral direction under the rear portions of black keys 1*e* and the rear portions of white keys 1*f*. The solenoid-operated key actuators 5 are respectively provided for the keys 1*e* and 1*f* so that the controller 11 selectively moves the keys 1*e* and 1*f* by means of the associated solenoid-operated key actuators 5.

Each of the solenoid-operated key actuators 5 includes a solenoid 5*a* and a plunger 5*b*. The controller 11 is connected to the solenoid 5*a*, and the driving signal DR flows through the solenoid 5*a* so as to create a magnetic field. The plunger 5*b* is provided inside the solenoid 5*a*, and the magnetic force is exerted on the plunger 5*b* so as make the plunger 5*b* upwardly project from the solenoid 5*a*. The projecting plunger 5*b* upwardly pushes the rear portion of associated key 1*e* or 1*f* without any finger force of a human player. When the driving signal DR is removed from the solenoid 5*a*, the plunger 5*b* is retracted into the solenoid 5*a* by means of a return spring (not shown). The retracted plunger 5*b* permits the rear portion of associated key 1*e* or 1*f* to descend due to the self-weight of action unit 2. Thus, the controller 11 selectively drives the black keys 1*e* and white keys 1*f* through the solenoid-operated key actuators 5.

The solenoid-operated pedal actuators 110*i*, 110*j* and 110*k* are provided in the pedal linkworks 110*d*, 110*e* and 110*f*, and are accommodated in the cabinet 1*a*. The controller 11 is connected in parallel to the solenoid-operated pedal actuators 110*d*, 110*e* and 110*f*, and the driving signals DR are selectively supplied from the controller 11 to the solenoid-operated pedal actuators 110*i*, 110*j* and 110*p*.

Figure 5:
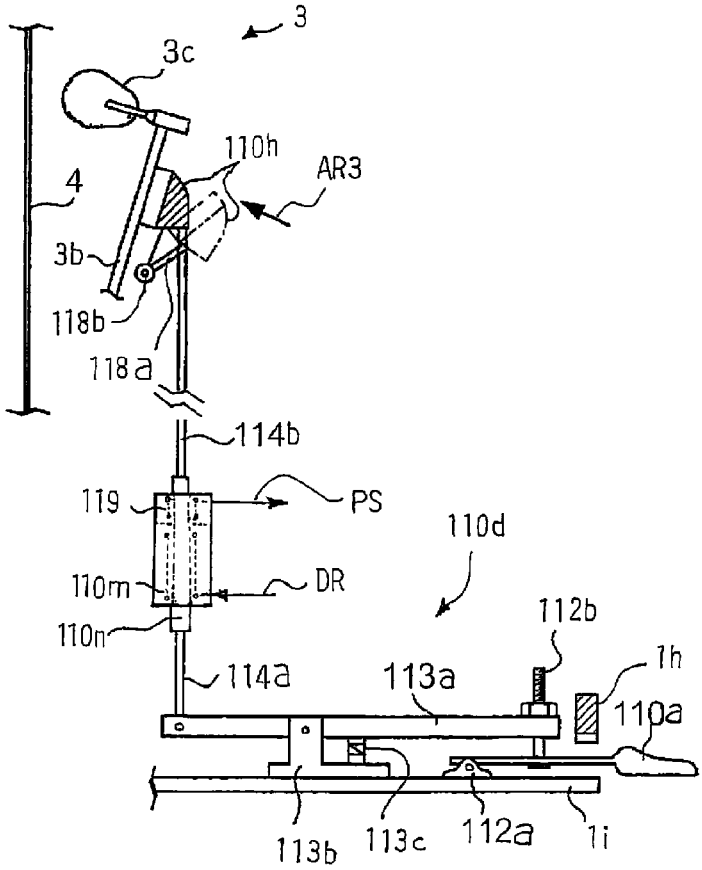
FIG. 5 is a schematic side view showing a soft pedal, a soft pedal linkwork and a hammer.

Turning to FIG. 5, the soft pedal 110*a* projects from a bottom sill 1*h*, and is rotatably supported by a bracket 112*a* on a bottom board 1*i*. The bottom sill 1*h* and bottom board 1*i* form parts of the cabinet 1*a*. The soft pedal linkwork 110*d* includes a soft pedal lever 113*a*, soft pedal rods 114*a* and 114*b*, an arm 118*a* and the hammer rail 110*h*. The soft pedal lever 113*a*, soft pedal rods 114*a* and 114*b* and arm 118*a* serve as the links of soft pedal linkwork 110*d*.

The soft pedal 110*a* is connected to the soft pedal lever 113*a* by means of a bolt 112*b*, and the soft pedal lever 113*a* is rotatably supported by a bracket 113*b* on the bottom board 1*i*. A return spring 113*c* is provided between a front portion of the soft pedal lever 113*a*, and the bracket 113*b*. For this reason, the front portion of soft pedal lever 113*a* is urged in the counter clockwise direction at all times. The soft pedal rod 114*b* is connected to the hammer rail 110*h*, and pushes and pulls the hammer rail 110*h*. The arm 118*a* is connected at one end thereof to the hammer rail 110*h* and at the other end thereof to a pin 118*b*. Since the pin 118*b* is rotatably supported by the action brackets (not shown), the soft pedal rod 114*b* gives rise to rotation of the arm 118*a* and rotation of hammer rail 110*h* about the pin 118*b*.

While any force is not being exerted on the soft pedal 110*a*, the return string 113*c* makes the soft pedal 110*a* stay at the original position through the soft pedal lever 113*a*, and the soft pedal linkwork 110*d* keeps the hammer rail 110*h* at the original position drawn by broken lines in FIG. 5. When force is exerted on the soft pedal 110*a*, the soft pedal 110*a* is depressed, and the soft pedal 110*a* pulls down the front portion of soft pedal lever 113*a*. The rear portion of soft pedal lever 113*a* is raised, and the soft pedal rods 114*a* and 114*b* are moved in the upward direction. The soft pedal rod 114*b* pushes the hammer rail 110*h*, and gives rise to the rotation in the direction indicated by arrow AR3. The hammer rail 110*h* pushes the hammer shanks 3*b* toward the strings 4. As a result, the distance between the hammer heads 3*c* and the strings 4 is reduced.

The solenoid-operated pedal actuators 110*i*, 110*j* and 110*k* are similar in construction to one another. For this reason, description is focused on the solenoid-operated pedal actuator 110*i* for the soft pedal linkwork 110*d*, and the component parts of other solenoid-operated pedal actuators 110*j* and 110*k* are labeled with references designating corresponding component parts of the solenoid-operated pedal actuator 110*i* in FIG. 2 without detailed description.

The solenoid-operated pedal actuator 110*i* has a solenoid 110*m*, a plunger 110*n* and a built-in plunger sensor 119. The solenoid 110*m* is supported by the cabinet 1*a*, and the driving signal DR flows through the solenoid 110*m* so as to create the magnetic field. The plunger 110*n* is inserted between the soft pedal link 114*a* and the soft pedal 114*b*, and is moved in the up-and-down direction with respect to the solenoid 110*m*. While the plunger 110*n* is moving in the upward direction in the magnetic field, the pedal linkwork 110*d* gives rise to the rotation of hammer rail 110*h* about the pin 118*b* in the counter clockwise direction, i.e., the direction indicated by the arrow AR3, and makes the distance between the hammer heads 3*c* and the strings 4 reduced without any force on the soft pedal 110*a*. The reduction of the distance results in that the jack 2*a* exerts the force on the hammer butt 3*a* during an initial stage of the hammer stroke shorter than that of the hammer stroke at the original position of hammer rail 110*h*. For this reason, the hammer assemblies 3 are accelerated within a time period shorter than that of the hammer assemblies 3 at the original position of hammer rail 110*h*, and the hammer heads 3*c* are softly brought into collision with the strings 4.

The built-in plunger sensor 119 monitors the plunger 110*n*, and converts the actual pedal velocity to a piece of pedal velocity data. The built-in plunger sensor 119 supplies a pedal velocity signal PS representative of the piece of pedal velocity data to the signal interface of the information processing system 111. The pieces of pedal velocity data are used in a servo control on the pedal 110*a*, and the amount of mean current of driving signal DR is varied through the servo control as will be hereinafter described in detail.

The solenoid-operated pedal actuators 1103 and 110*k* behave as similar to the solenoid-operated pedal actuator 110*i*. Thus, the soft pedal 110*a*, muffler pedal 110*b* and damper pedal 110*c* are selectively driven through the solenoid-operated pedal actuators 110*i*, 110*j* and 110*k* by the controller 11 instead of a human player.

System Configuration of Recording System

Turning to FIG. 2 of the drawings, the recording system 100*c* includes hammer sensors 7, the information processing system 111 and key sensors 8. The information processing system 111 and key sensors 8 are shared between the automatic playing system 100*b* and the recording system 100*c*. Each of the hammer sensors 7 is implemented by the combination of photo coupler 101 and photo modulator 102. The photo modulator 102 is fitted to each of the hammer shank 3*b*, and is moved together with the hammer assembly 3. On the other hand, the photo coupler 101 is supported by the action brackets (not shown) by means of a suitable framework (not shown), and is stationary. The hammer assembly 3 gives rise to relative motion between the photo coupler 101 and the photo modulator 102, and the hammer sensor 7 produces a hammer position signal HS representative of a piece of hammer position data during the travel on the hammer trajectory, and the hammer position signal HS is supplied from the hammer sensor 7 to the signal interface of the information processing system 111. The entire hammer trajectory is fallen within the detectable range of the hammer sensor 7. The piece of hammer position data expresses a hammer position.

Another subroutine program of the computer program is designed to record performances on the upright piano 100*a*. White the central processing unit 11*a* is reiterating the subroutine program for the recording, music data codes are produced on the basis of the pieces of key position data and pieces of hammer position data, and the set of music data codes, which expresses the performance on the upright piano 100*a*, is stored in the standard MIDI file. The standard MIDI file is stored in the disk driver 120 and/or is transmitted to a server computer, another electronic key board or another automatic player piano through a cable or a public communication network.

Computer Program

The automatic performance and recording are carried out through the execution of computer program. The computer program is broken down into a main routine program and subroutine programs, and the main routine program conditionally branches to the subroutine programs. As described hereinbefore, one of the subroutine programs is assigned to the automatic performance, and another subroutine program is assigned to the recording. Yet another subroutine program is assigned to a data transfer from the signal interfaces to the random access memory 11*c*.

When a user turns of a power switch, the central processing unit 11*a* starts the main routine program. The central processing unit 11*a* firstly initializes the information processing system 111, and calibrates the look-up tables for the hammer sensors 7 and key sensors 8. After the initialization and calibration, the central processing unit 11*a* starts to communicate with users. The central processing unit 11*a* produces visual images expressing a job list on the touch screen of the manipulating panel 130, and waits for an instruction of users. In other words, the central processing unit 11*a* reiterates a loop of the main routine program for the communication with users. The automatic performance and recording are written in the job list.

When a user selects a job from the job list, the central processing unit 11*a* raises the flag expressing the selected job, and the main routine program periodically branches to the subroutine program for the selected job. In case where the flag expressing the automatic performance or recording has been raised, the main routine program further periodically branches to the subroutine program for the data transfer from the signal interfaces to the random access memory 11*c*, and the central processing unit 11*a* writes the current key positions or the current key positions and current hammer positions in the corresponding data tables in the random access memory 11*c*. Since the subroutine program for the data transfer has priority over the subroutine program for the automatic performance and the subroutine program for the recording, the central processing unit 11*a* carries out data analysis for the keys 1*e*/1*f* and hammers 3 on the latest pieces of key position data and the latest pieces of hammer position data.

A user is assumed to select the recording from the job list. The main routine program periodically branches to the subroutine program. When the main routine program branches to the subroutine program for the recording, the central processing unit 11*a* checks the data table for the keys 1*e* and 1*f* to see whether or not any one of the keys 1*e* and 1*f* changes the key position. When the human player depresses a key 1*e* or 1*f*, the central processing unit 11*a* writes the key number of the depressed key in a list of depressed keys, and reads the time at which the human player depresses the key 1*e* or 1*f* on the internal clock for storing a piece of time data expressing the time in the memory location assigned to the depressed key 1*e* and 1*f*. Then, the central processing unit 11*a* starts to analyze the pieces of hammer position data together with the pieces of key position data. It is possible to determine a key velocity of the depressed key 1*e* or 1*f* on the basis of a series of values of the key position data.

On the other hand, when the human player releases the depressed key 1*e* or 1*f*, the central processing unit 11*a* removes the key number from the list of depressed keys, and writes the key number of released key 1*e* or 1*f* in a list of released keys. The central processing unit 11*a* reads the time at which the human player releases the depressed key 1*e* or 1*f* on the internal clock, and stores a piece of time data expressing the time in the memory location assigned to the released key 1*e* or 1*f*.

While the key number is being on the list of depressed keys, the central processing unit 11*a* checks the pieces of hammer position data to see whether or not the hammer assembly 3 changes the direction of movement, i.e., the hammer assembly 3 is brought into collision with the string 4. When the answer is given affirmative, the central processing unit 11*a* reads the time at which the hammer assembly 3 changes the direction of movement, and determines a piece of duration data expressing a duration between the previous key event and the collision. The central processing unit 11*a* further calculates the final hammer velocity on the basis of a series of values of the hammer position data. The final hammer velocity is proportional to the loudness of the tone produced through the vibrations of string 4. Pieces of performance data, which express the key number, loudness, duration and so forth, are stored in the music data code for a note-on key event.

On the other hand, while the released key 1*e* or 1*f* is on the list of released keys, the central processing unit 11*a* calculates a released key velocity on the basis of a series of key position data, and estimates the time at which the damper head 6*b* is brought into contact with the vibrating string 4, i.e., the time to decay the tone. The central processing unit 11*a* determines the duration from the previous key event, i.e., the previous note-on key event or the previous note-off key event to the time to decay the tone, and the pieces of performance data, which expresses the key number, duration and so forth, are stored in the music data code for the note-off key event.

When the human player selectively depresses the soft pedal 110*i*, muffler pedal 110*j* and damper pedal 110*k*, the central processing unit 11*a* produces control change messages corresponding to the effects of the depressed pedals 110*i*, 110*j* and 110*k*, and stores the control change messages in pedal-on event data codes. On the other hand, when the human player releases the soft pedal 110*i*, muffler pedal 110*j* and damper pedal 110*k* from the depressed state, the central processing unit 11*a* stores control change messages in pedal-off event data codes.

While the human player is performing a music tune on the upright piano 100*a*, the central processing unit 11*a* repeats the above-described job sequence for the depressed keys 1*e* and 1*f* and released keys 1*e* and 1*f* so as to produce the music data codes expressing the performance. When the human player completes the performance on the upright piano, he or she pushes the visual image of stop switch. Then, the central processing unit 11*a* deletes the individuality of upright piano 100*a* from the note-on key event data codes, note-off key event data codes, pedal-on event data codes and pedal-off event data codes, i.e., normalizes the music data codes, and stores the set of music data codes in the standard MIDI file as plural sorts of the music data codes.

A software module "music data producer" expresses the above-described job sequence during the recording in FIG. 2.

Subsequently, description is made on the subroutine program for automatic performance on the upright piano 100*a*. Jobs of the subroutine program for automatic performance are equivalent to software modules "piano controller 10", "motion controller 12*a*" and "servo controller 12*b*" as shown in FIG. 2. When a user selects the automatic performance from the job list on the touch screen of manipulating panel 130, the central processing unit 11*a* raises the flag expressing the automatic performance, and reproduces visual images expressing a list of music tunes, the standard MIDI files of which have been already stored in the disk driver 120. In case where the user can not find his or her favorite music tune in the list of music tunes, he or she may load another disk plate DK in the disk driver, or downloads from a suitable database through a communication network.

When the user selects a favorite music tune from the list, the standard MIDI file is transferred to the random access memory 11*c*, and the visual images expressing a start switch, a stop switch, an interruption switch and so forth are produced on the touch screen of manipulating panel 130. Thus, the automatic playing system 100*b* gets ready to perform the favorite music tune on the upright piano 100*a*.

The user is assumed to bring his or her finger into contact with the visual image of start switch. The main routine program starts periodically to branch to the subroutine program for the automatic performance and the subroutine program for the data transfer.

The piano controller 10 behaves as follows. When the set of music data codes is transferred to the random access memory 11*c*, the central processing unit 11*a* sets the internal clock by the duration data code closest to the present time. The duration data code expresses the duration from the initiation of automatic performance or the key event and/or pedal event presently taken place to the next key event and/or pedal event. The internal clock is periodically decremented. When the internal clock reaches zero, the central processing unit 11*a* transfers the key event code and/or pedal event data code to the motion controller 12*a*. The piano controller 10 repeats the setting work on the internal clock, decrementing the internal clock and transfer of the key event data codes and pedal event data code to the motion controller 12*a* until the end of the favorite music tune.

The piano controller 10 further checks the current pedal position of soft pedal 110*a* to see whether the soft pedal 110*a* is in on-state or off-state. The piano controller 10 determines the actual pedal position on the basis of a series of values of the actual pedal velocity expressed by the pedal velocity signal PS through integration, and compares the value of actual pedal position with a critical value at which the effect of soft pedal 110*a* is imparted to the tones. When the actual pedal position exceeds the critical value, the central processing unit 11*a* determines that the soft pedal 110*a* is in the on-state, and raises a pedal state flag PF. While the soft pedal 110*a* is being in the on-state, the central processing unit 11*a* keeps the pedal state flag PF raised. On the other hand, if the actual pedal position is less than the critical value, the effect of soft pedal 110*a* is not imparted to the tone. Then, the central processing unit 11*a* takes down the pedal state flag PF. The piano controller 10 informs the servo controller 12*b* of the pedal state as indicated by a data line for the pedal state flag PF in FIG. 2.

The motion controller 12*a* analyzes the key event data codes and pedal event data codes, and determines the reference forward key trajectory, reference backward key trajectory, a reference forward pedal trajectory and a reference backward pedal trajectory for each depressed key, each released key, each depressed pedal and each released pedal. In the following description, term "reference key trajectory" and "reference pedal trajectory" means any one of the reference forward key trajectory and reference backward key trajectory and any one of the reference forward pedal trajectory and reference backward pedal trajectory.

As described in conjunction with the related arts, the reference forward key trajectory is a series of values of target key position toward the end position, and the target key position on the reference forward key trajectory is varied together with time. While a key 1*e* or 1*f* is traveling on the reference forward key trajectory, the key 1*e* or 1*f* passes the reference point at a target value of the reference key velocity, and the key 1*e* or 1*f* at the target value of reference key velocity causes the associated hammer head 3*c* to be brought into collision with the string 4 at a target value of the final hammer velocity at a target time. Thus, the loudness of tone is controllable by the key 1*e* or 1*f* forced to travel on the reference forward key trajectory.

Similarly, the reference backward key trajectory is also a series of values of the target key position toward the rest position, and the target key position is varied together with time. If the released key 1*e* or 1*f* is forced to travel on the reference backward key trajectory, the released key 1*e* or 1*f* makes the associated damper head 6*b* brought into contact with the vibrating string 4 at the target time when the tone is to be decayed.

The black keys 1*e* and white keys 1*f* travels between the rest positions and the end positions so that the maximum key stroke is equal to about 10 millimeters. Accordingly, the values of target key positions on the reference key trajectories are variable by about 10 millimeters. The unit of target key positions is millimeter, and the values are fallen within the range of 0 millimeter to 10 millimeters, i.e., the full key stroke from the rest position to the end position.

The reference forward pedal trajectory is a series of values of target pedal position for the pedal 110*i*, 110*j* or 110*k* moved in the downward direction, and the target pedal position is varied with time. The pedal effect is imparted to the tone or tones at a target time under the condition that the pedal 110*i*, 110*j* or 110*k* is forced to travel on the reference forward pedal trajectory.

The reference backward pedal trajectory is also a series of target pedal position for the pedal 110*i*, 110*j* or 110*k* moved toward the upward direction, and the target pedal position for the pedal 110*i*, 110*j* or 110*k* moved in the upward direction, and the target pedal position is varied with time. The pedal effect is removed from the tone or tones at a target time in so far as the pedal 110*i*, 110*j* or 110*k* is moved on the reference backward pedal trajectory.

When the key event data code is supplied from the piano controller 10, the motion controller 12*a* specifies the key 1*e* or 1*f* and the target time on the basis of the key event data code, and determines the reference key trajectory. The persons skilled in the art have known how to determine the reference key trajectory and reference pedal trajectory. For this reason, detailed description is omitted for the sake of simplicity. The motion controller 12*a* periodically supplies the values of target key positions to the servo controller 12*b*. In this instance, the values of target key position for each key 1*e* or 1*f* are supplied from the motion controller 12*a* to the servo controller 12*b* at intervals of 1 millisecond, which is equal to the intervals of data transfer for the actual key position.

Similarly, the motion controller 12*a* periodically supplies the values of target pedal position to the servo controller 12*b* for the servo control on the pedal 110*a*, 110*b* or 110*c*.

Figure 6:
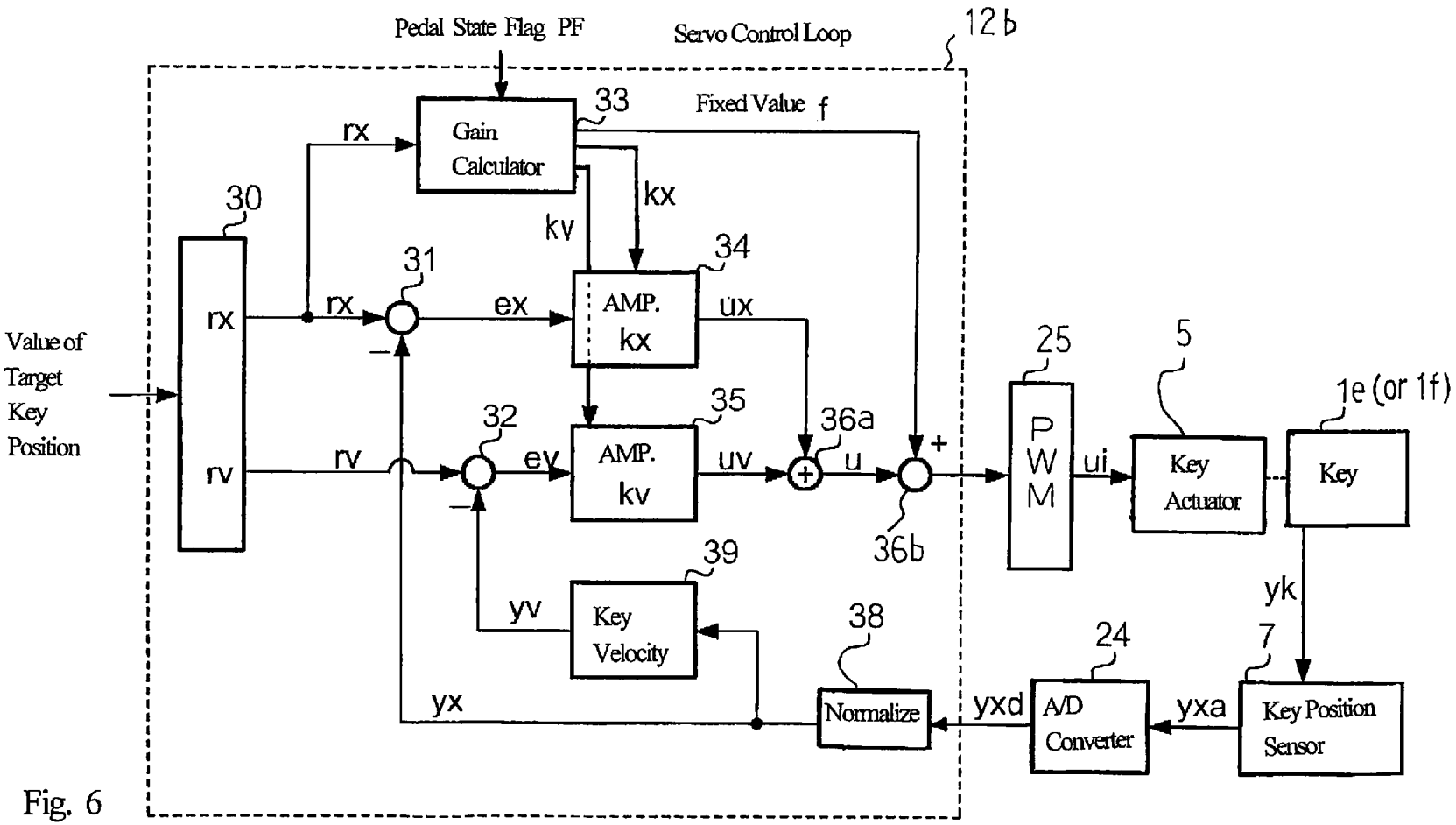
FIG. 6 is a block diagram showing the control sequence of a servo controller.

Since the solenoid-operated key actuators 5 and the keys 1*e* and 1*f* of upright pianos 100*a* are different mechanisms independent of each other, The servo controller 12*b* can concurrently force plural keys 1*e* and 1*f* and at least one pedal 110*i*, 110*j* or 110*k* to travel on the reference key trajectories and reference pedal trajectory. The servo control sequence is illustrated in FIG. 6. Although the servo controller 12*b* forces the keys 1*e* and 1*f* and pedal 110*i*, 110*j* or 110*k* to travel on the reference key trajectories and reference pedal trajectory in parallel through plural servo control sequences, only one servo control sequence is hereinafter described with reference to FIG. 6 for the sake of simplicity.

A key 1*e* or 1*f* is assumed to be moved from the rest position toward the end position in the automatic performance. The note-on key event data code is supplied from the piano controller 10 to the motion controller 12*a*, and the motion controller 12*a* determines the reference forward key trajectory for the key 1*e* or 1*f*. The motion controller 12*a* periodically supplies the value rx of target key position to the servo controller 12*b* at intervals of 1 millisecond, and the servo controller 12*b* starts the servo control through the loop shown in FIG. 6. The following functions are executed at intervals of 1 millisecond in the servo control loop.

The key 1*e* or 1*f* is found at the rest position at the initiation of the servo control, and the key position sensor 7 supplies the analog key position signal KS representative of a value yxa of the actual key position. The analog key position signal KS is converted to the digital data signal through the analog-to-digital converter 24 of the signal interface incorporated in the information processing system 111.

The digital data signal expresses a discrete value yxd of the target key position, and the discrete value yxd is temporarily stored in the data buffer of the signal interface. When the main routine program branches to the subroutine program for data transfer, the discrete value yxd is transferred from the data buffer to the random access memory 11*c*, and is written in the memory location assigned to the key 1*e* or 1*f*. The latest discrete value yxs is renewed at intervals of 1 millisecond.

The central processing unit 11*a* eliminates the individuality of key position sensor 7 and the individuality of depressed key 1*e* or 1*f* from the discrete value yxd of actual key position as indicated by a function block 38, and determines a normalized discrete value yx. Thereafter, the central processing unit 11*a* calculates an actual key velocity on the basis of the normalized discrete value yx and previous normalized discrete value or values yx so as to determine a value yv of the actual key velocity as indicated by a function block 39.

When a value rx of target key position reaches the servo controller 12*b*, the central processing unit 11*a* calculates the target key velocity on the basis of the newly supplied value rx and the previously supplied value or values rx through differentiation such as, for example, a polynomial adaptation, and determines a value rv of the target key velocity as indicated by a function block 30. For example, in order to determine the key velocity at a certain time, the previous seven values and next seven values are taken out from the data table, and determines the value of key velocity at the certain time by adapting these values to a quadratic curve. The unit of target key velocity is millimeters per second, i.e., mm/s, and the values rv is found in the range from zero to 500 millimeters.

Subsequently, the central processing unit 11*a* respectively compares the value rx of target key position and the value rv of target key velocity with the value yx of actual key position and the value yv of actual key velocity, and determines a difference ex between the value rx of target key position and the value yx of actual key position and a difference ev between the value rv of target key velocity and the value yv of actual key velocity as indicated by function blocks 31 and 32.

The value rx of target key position is supplied to a function block "gain calculator" 33 as well as the function block 31. Although the plungers 5*b* of solenoid-operated key actuators 5 and the plungers 110*n* of solenoid-operated pedal actuators 110*i*, 110*j* and 110*k* are brought into contact with the associated keys 1*e* and 1*f* and the associated pedals 110*a*, 110*b* and 110*c*, the keys 1*e* and 1*f* and pedals belong to mechanical systems different from mechanical systems to which the plungers 5*b* and 110*n* belong, and are different in motion transfer characteristics. For this reason, it is hard to reproduce the key movements expressed by the reference key trajectories and the pedal movements expressed key the reference pedal trajectories through the servo control simply on the basis of the differences ex and ev. In order accurately to reproduce the key movements on the reference key trajectories and the pedal movements on the reference pedal trajectories, the differences ex and ev are weighted by a position gain kx and a velocity gain kv, and the sum of products between the differences ex and ev and gains kx and kv is further weighted by a fixed value f.

As described hereinbefore, the jacks 2*a* and hammer assemblies 3 differently behave depending upon current state of the soft pedal 110*a*. The present inventor found that the difference in behavior was absorbed by changing the position gain kx, velocity gain kv and fixed value f on the reference forward key trajectories. For this reason, the gain calculator 33 is provided for the accurate reproduction of the key movements.

Figures 7, 8, 9:
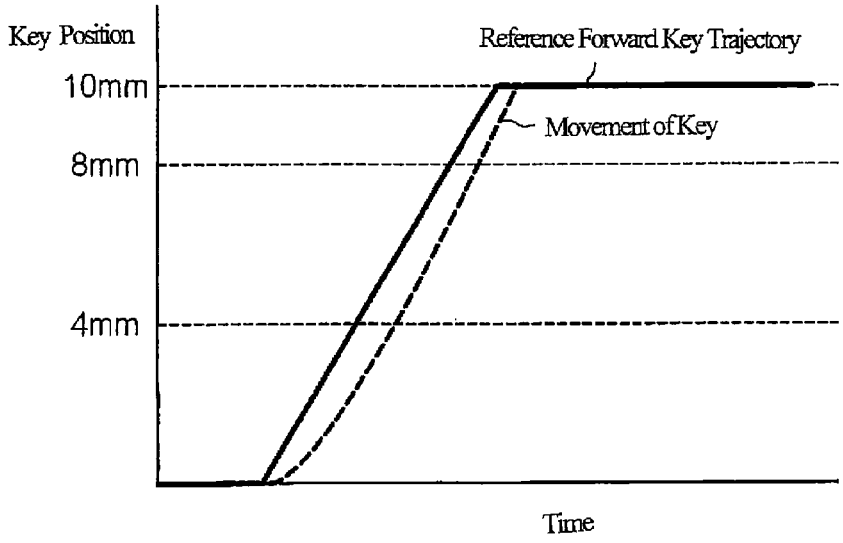
FIG. 7 is a view showing a gain table used in the servo control under the condition that the soft pedal is depressed.
FIG. 8 is a view showing another gain table used in the servo control under the condition that the soft pedal is not depressed.
FIG. 9 is a graph showing an actual key position on a reference forward key trajectory under the condition that the gain table shown in FIG. 8 is used without depressing the soft pedal.

As described hereinbefore in conjunction with the read only memory 11*b*, the gain tables are defined in the read only memory 11*b*, and are illustrated in FIGS. 7 and 8. FIG. 7 shows a relation between target key position rx and the position gain kx, velocity gain kv and fixed value f under the condition that the soft pedal 110*a* has exceeded the critical value, i.e., the pedal-on state. In this situation, the pedal state flag PF has been already raised. On the other hand, FIG. 8 shows a relation between target key position rx and the position gain kx, velocity gain kv and fixed value f under the condition that the pedal position of soft pedal 110*a* is found between the original position and the critical value, i.e., the pedal-off state. In this situation, the piano controller 10 keeps the pedal state flag PF down. The target key position kv is equivalent to a key stroke from the rest position.

When the pedal state flag PF is found to be raised, the central processing unit 11*a* accesses the gain table shown in FIG. 7, and reads the position gain kx, velocity gain kv and fixed value f depending upon the value rx of target key position rx. If the value rx is found between zero and 4 millimeters, 0.3, 0.3 and 10% of the value rv of target key velocity are read out from the gain table as the position gain kx, velocity gain and fixed value f, and are supplied to an amplifier 34, an amplifier 35 and an adder 36*b*, respectively. If the value rx is greater than 4 millimeters and less than 8 millimeters, the position gain kx is unchanged from 0.3, and the velocity gain kv and fixed value f are changed to 0.5 and {9%+(rv−100)/100%}. If the value rx is equal to or greater than 8 millimeters, the position gain kx and velocity gain kv are changed to 0.15 and 0.6, respectively, and the fixed value f is maintained at {9%+(rv−100)/100% }. The value at the boundary between the first numerical range and the second numerical range, i.e., 4 millimeters is greater than the gap between the jacks 2*a* and the hammer butt 3*a* under the condition of pedal-on state, i.e., 3 millimeters, and is less than twice of the value of gap.

If the pedal state flag PF has been taken down, the central processing unit 11*a* accesses the gain table shown in FIG. 8 instead of the gain table shown in FIG. 7, and reads the position gain kx, velocity gain kv and fixed value f depending upon the value rx of target key position rx. If the value rx is found between zero and 4 millimeters, 0.5, 0.4 and {9%+(rv−100)/100%} are read out from the gain table as the position gain kx, velocity gain and fixed value f, and are supplied to the amplifier 34, amplifier 35 and adder 36*b*, respectively. If the value rx is greater than 4 millimeters and less than 8 millimeters, the position gain kx and velocity gain kv are changed to 0.3 and 0.5, and the fixed value f is unchanged. If the value rx is equal to or greater than 8 millimeters, the position gain kx and velocity gain kv are changed to 0.15 and 0.6, respectively, and the fixed value f is maintained at {9%+(rv−100)/100%}.

Comparing the gain table shown in FIG. 7 with the gain table shown in FIG. 8, at least the position gain kx and velocity gain kv are decreased in the region of target key position rx from zero to 4 millimeters on the condition that the effect of soft pedal 110*a* is imparted to the tones. This is because of the fact that the hammer butts 3*a* have been spaced from the heads of jacks 2*a* before the keys 1*e* and 1*f* are depressed. The space is of the order of 3 millimeters. For this reason, the load of solenoid-operated key actuators 5 is reduced until the jacks 2*a* are bought into contact with the hammer butts 3*a*. If the gain table shown in FIG. 8 is applied to the servo control regardless of the state of soft pedal 110*a*, the plungers 5*b* is excessively accelerated and strongly decelerated due to the large position gain kx and large velocity gain kv. In order to prevent the solenoid-operated key actuators 5 from the excessive acceleration and strong deceleration, the other gain table is prepared for the servo control under the on-state of soft pedal 110*a*. The reduction of position gain kx and velocity gain kv results in restriction of oscillation. The plural gain tables are preferable to a single gain table from the viewpoint that the servo controller 12*b* forces the key 1*e* or 1*f* strictly to travel on the reference forward key trajectory.

The values of position gain kx, values of velocity gain kv and fixed values f are determined through experiments and/or computer simulation.

Turning back to FIG. 6, the value of target key position rx and the pedal state flag PF are input to the gain calculator 33. The central processing unit 11*a* selects the gain table shown in either FIG. 7 or FIG. 8, and compares the value of target key position rx with the critical values at the boundaries of the three regions, i.e., 4 millimeters and 8 millimeters so as to select one of the three regions in the selected gain table. The central processing unit 11*a* reads out the value of position gain kx, the value of velocity gain kv and the value of fixed value f from the selected gain table. As described hereinbefore, the value of target key position rx is renewed at the intervals of 1 millisecond, and the value of position gain kx and value of velocity gain kv and fixed value f are also changed at intervals of 1 millisecond. Thus, the function of gain calculator 33 is realized.

The value of position gain kx, value of velocity gain kv and fixed value f are supplied to the amplifier 34, amplifier 35 and adder 36*b*, respectively. The differences ex and ev are multiplied by the value of position gain kx and the value of velocity gain kv, respectively. The position difference ex in millimeter and the velocity difference ev in millimeter/second are converted to a value of percentage due to the position component and another value of percentage due to the velocity component. Thus, the units, i.e., millimeter and millimeter/second are converted to another unit, i.e., percentage through the amplification.

The products ux and uv are added to each other at the adder 36*a*, and the fixed value f is further added to the sum u of products at the adder 36*b*. The sum (u+f) expresses a duty ratio of the driving signal DR, i.e., the target amount ui of mean current of the driving signal DR.

The piece of control data, which expresses the sum (u+f) is supplied from the information processing system 111 to the pulse width modulator 25, and the pulse width modulator 25 adjusts the duty ratio of driving signal DR to a value corresponding to the target amount of mean current ui. The driving signal DR flows into the solenoid 5*a* of solenoid-operated key actuator 5 provided for the key 1*e* or 1*f*. The driving signal DR keeps the strength of electromagnetic field unchanged or changes the strength depending upon the value of duty ratio. When the duty ratio of driving signal DR is unchanged, the solenoid-operated key actuator 5 keeps the thrust on the lower surface of key 1*e* or 1*f* unchanged. However, if the duty ratio of driving signal DR is increased or decreased, the key 1*e* or 1*f* is accelerated or decelerated.

The key 1*e* or 1*f* changes the actual key position yxa, and the key position sensor 7 varies the potential level of the analog key position signal KS. Accordingly, the analog-to-digital converter 24 varies the discrete value yxd of the output signal. When the next servo control loop starts, the next value rx of target key position is supplied to the function block 30, and the discrete value yxd is normalized for the comparison between the target key position and the actual key position. Thus, the above-described servo control loop is periodically repeated until the key 1*e* or 1*f* reaches the end of reference forward key trajectory.

When the depressed key 1*e* or 1*f* is to be released, the motion controller 12*a* determines the reference backward key trajectory for the released key 1*e* or 1*f*, and the servo controller 12*b* forces the released key 1*e* or 1*f* to travel on the reference backward key trajectory as similar to that on the reference forward key trajectory.

When one of the pedals 110*a*, 110*b* or 110*c* is to be depressed and released, the motion controller 12*a* and servo controller 12*b* behave as similar to those for the depressed key and released key 1*e* or 1*f*.

The piano controller 10, motion controller 12*a* and servo controller 12*b* repeats the above-described jobs in all of the note-on key events, note-off key events, pedal-on events and pedal-off events in the standard MIDI file, and selectively drives the black keys 1*e*, white keys 1*f* and pedals 110*a*, 110*b* and 110*c* for reproducing the performance.

Experiments

The present inventor confirmed the advantages of selective usage of gain tables through experiments. The present inventor servo controlled a key 1*e* or 1*f* by using the gain table shown in FIG. 8 under the condition that the soft pedal 110*a* was not depressed. The reference forward key trajectory was drawn by using a real line, and the actual key position was varied as indicated by broken lines in FIG. 9. The broken lines were varied almost in parallel to the reference forward key trajectory. The difference between the real line and the broken lines was indicative of the standard capability of servo control loop.

Figure 10:
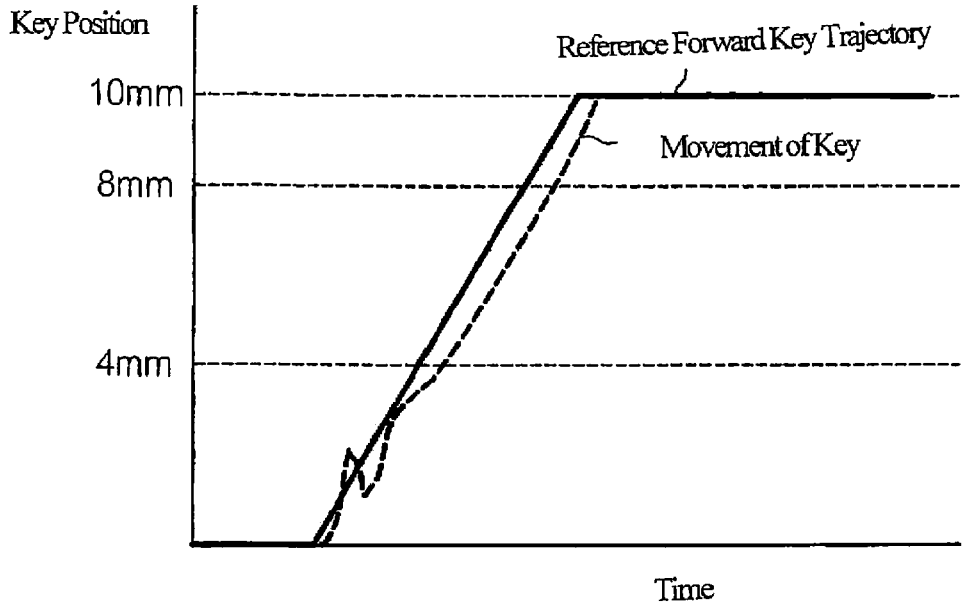
FIG. 10 is a graph showing an actual key position on the reference forward key trajectory under the condition that the gain table shown in FIG. 8 is used in the presence of depressed soft pedal.

Subsequently, the present inventor servo controlled the key 1*e* or 1*f* under the condition that the soft pedal 110*a* was depressed. The gain table shown in FIG. 8 was used in the servo control on the key 1*e* or 1*f*, and the actual key position was plotted in FIG. 10. On the other hand, the gain table shown in FIG. 7 was used in the servo control on the key 1*e* or 1*f*, and the actual key position was plotted in FIG. 11.

Figure 11:
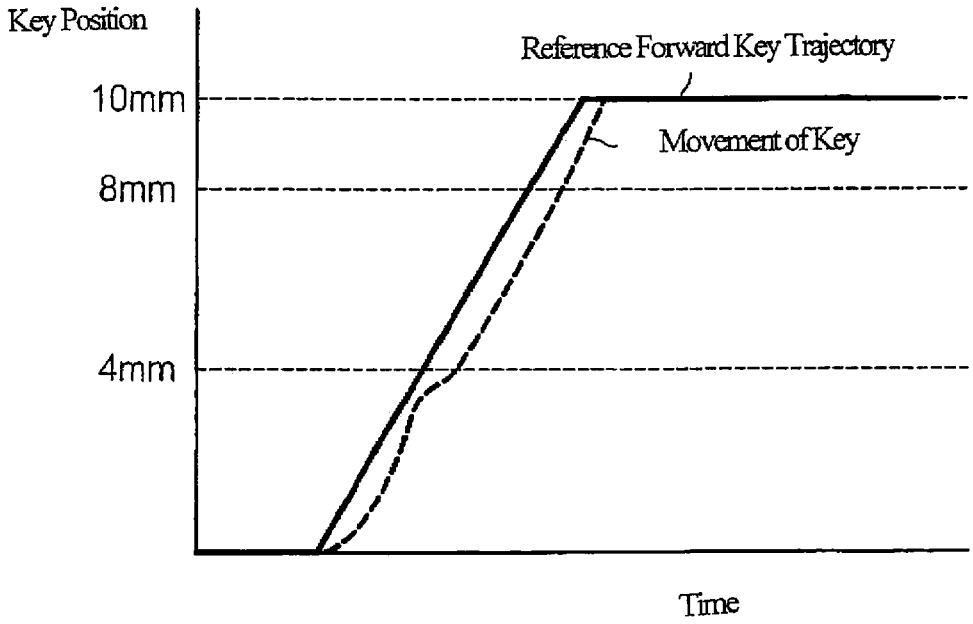
FIG. 11 is a graph showing an actual key position on the reference forward key trajectory under the condition that the gain table shown in FIG. 7 is used in the presence of depressed soft pedal.

Comparing the plots in FIG. 11 with the plots in FIG. 9, the plots shown in FIG. 11 exhibit the tendency close to the tendency of the plots shown in FIG. 9. The key 1*e* or 1*f* was not oscillated. However, the plots shown in FIG. 10 exhibit quite different tendency from the tendency shown in FIG. 9. The plots shown in FIG. 10 twice cross the reference forward key trajectory, and become close to and spaced from the reference forward key trajectory. In other words, the key 1*e* or 1*f* was oscillated. The key 1*e* or 1*f* unstably behaved under the condition that the gain table shown in FIG. 8 was used. Thus, the selective usage of the gain tables shown in FIGS. 7 and 8 is conducive to the stable servo control on the keys 1*e* and 1*f* rather than the simple usage of the gain table shown in FIG. 8.

As will be understood from the foregoing description, it is advantageous to reduce the position gain kx and velocity gain kv under the condition that the soft pedal 110*a* is depressed. This is because of the fact that the load on the solenoid-operated key actuators 5 is reduced due to the gap between the jacks 2*a* and the hammer butts 3*a* under the condition that the soft pedal 110*a* is changed to the on-state. The present invention is conducive to good reproducibility of the servo control on the keys 1*e* and 1*f*.

The oscillation of keys 1*e* and 1*f* sometimes results in that the hammer assembly 3 is unintentionally bought into collision with the string 4, twice, i.e., double strike on the string 4. The reduction of gains is effective against the oscillation of keys 1*e* and 1*f* and, accordingly, the double strike.

Second Embodiment

Figure 12:
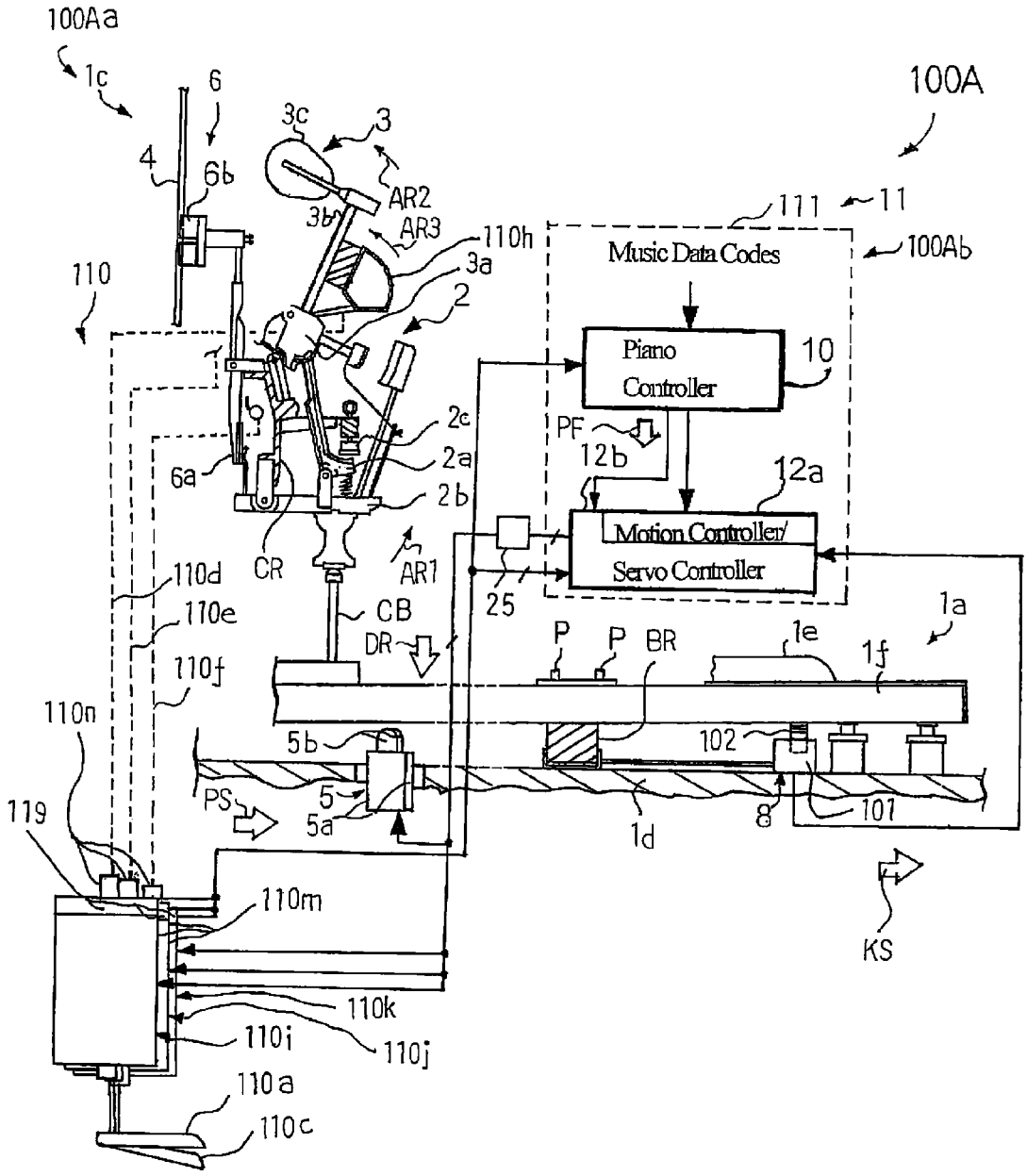
FIG. 12 is a cross sectional side view showing the structure of another automatic player piano of the present invention.

Turning to FIG. 12, another automatic player piano 100A embodying the present invention largely comprises an upright piano 100Aa and an automatic playing system 100Ab. Any recording system is not incorporated in the automatic player piano 100A.

The upright piano 100Aa is similar in structure to the upright piano 100*a* so that component parts of the upright piano 100Aa are labeled with references designating the corresponding component parts of the upright piano 100*a* without detailed description.

The automatic playing system 100Ab is similar in system configuration to the automatic playing system 100*b*, and, accordingly, system components of the automatic playing system 100Ab are labeled with references designating the corresponding system components of automatic playing system 100*b*. A computer program, which runs on the central processing unit 11*a* of the automatic playing system 100Ab, is same as the computer program in the automatic playing system 100*b* except for a part of the subroutine program for servo control. For this reason, description is focused on the part of subroutine program for servo control with reference to FIG. 13.

Figure 13:
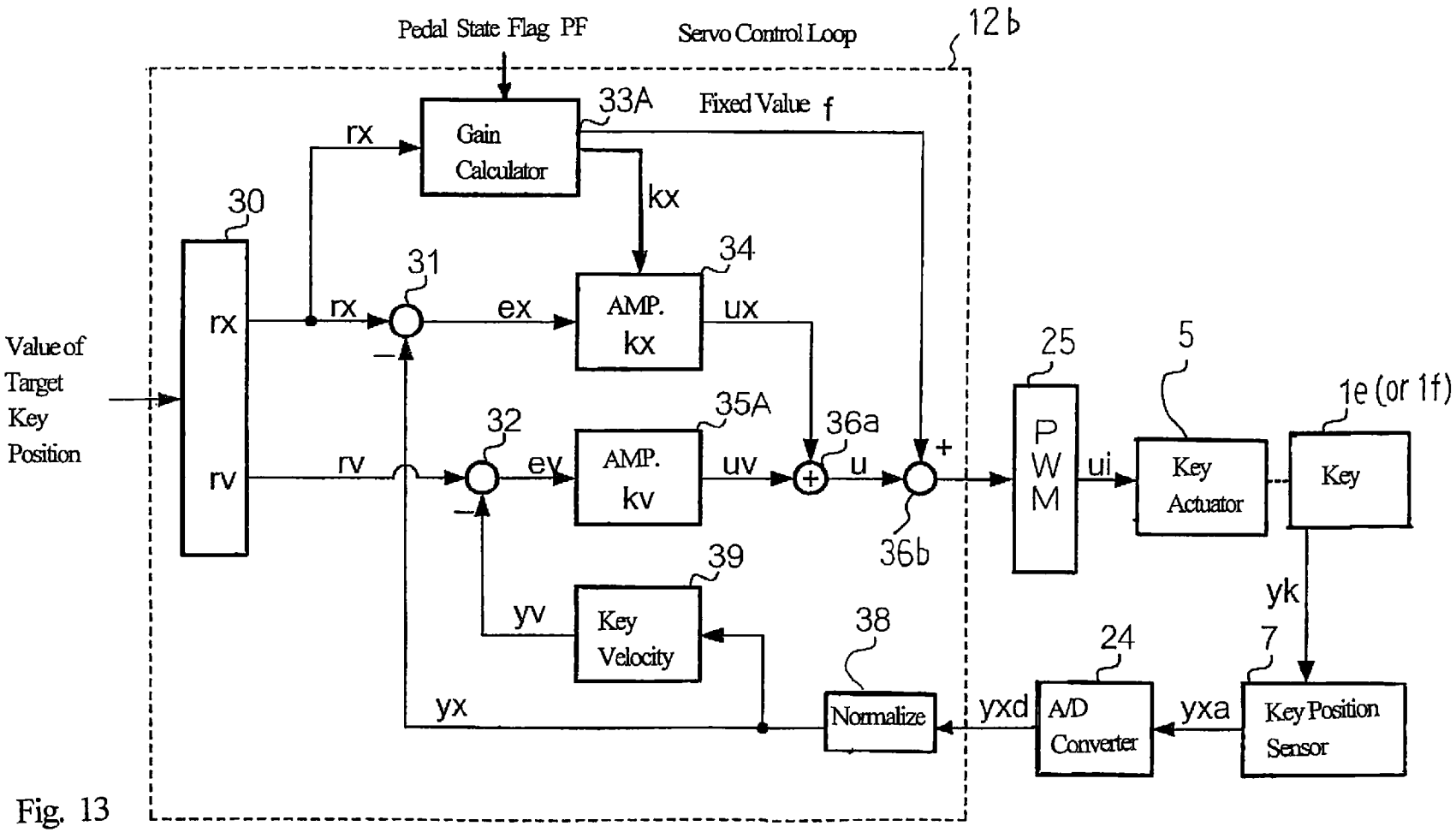
FIG. 13 is a block diagram showing a servo control loop created in another automatic player piano of the present invention.

FIG. 13 shows a servo control loop realized through the execution of subroutine program for servo control. The functions of the servo control loop shown in FIG. 13 are same as those of the functions 30, 31, 32, 34, 36*a*, 36*b*, 38 and 39 of servo control loop shown in FIG. 6 except for gain calculator 33A and an amplifier 35A. For this reason, the functions in the servo control loop shown in FIG. 13 are labeled with references designating the functions shown in FIG. 6 without detailed description.

The gain calculator 33A is different from the gain calculator 33 in that a value of velocity gain kv and a fixed value f are not changed between the pedal-on state of soft pedal 110*a* and the pedal-of state. in dependence on the current pedal state of soft pedal 110*a*. Only a value of the position gain kx is changed between the pedal-on state of soft pedal 110*a* and the pedal-off state. The value of velocity gain kv is defined in the subroutine program for servo control, and, for this reason, any data line is not drawn between the gain controller 33A and the amplifier 35A, and symbol "kv" is put in the block expressing the amplifier 35A. In this instance, the velocity control is weighted in the servo control, and the value of velocity gain kv is greater than the values of position gain kx.

In detail, while the soft pedal 110*a* is being maintained in the pedal-off state, the central processing unit 11*a* selects one of the certain values of position gain kx from the gain table for the pedal-off state depending upon the numerical range where the target key position rx is fallen, and the fixed value f is calculated on the basis of the value of velocity gain kv in a similar manner to the gain calculator 33. The selected value of position gain kx and fixed value f are supplied from the gain calculator 33A to the amplifier 34 and adder 36*b*.

When the player depresses the soft pedal 110*a*, the pedal state flag PF is raised. In the servo control on the keys 1*e* and 1*f*, the gain table for pedal-on state is accessed, and the gain calculator 33A selects one of the values of position gain kx depending upon the target key position rx, and calculates the fixed value f. The value of position gain kx for the numerical range closest to the rest position is less than the value of position gain kx for the same numerical range in the gain table for the pedal-off state. The selected value of the position gain kx and constant fixed value f are supplied from the gain calculator 33A to the amplifier 34 and the adder 36*b*. As a result, the keys 1*e* and 1*f* are less liable to oscillate, and the strings 4 are prevented from the double strike.

Third Embodiment

Figure 14:
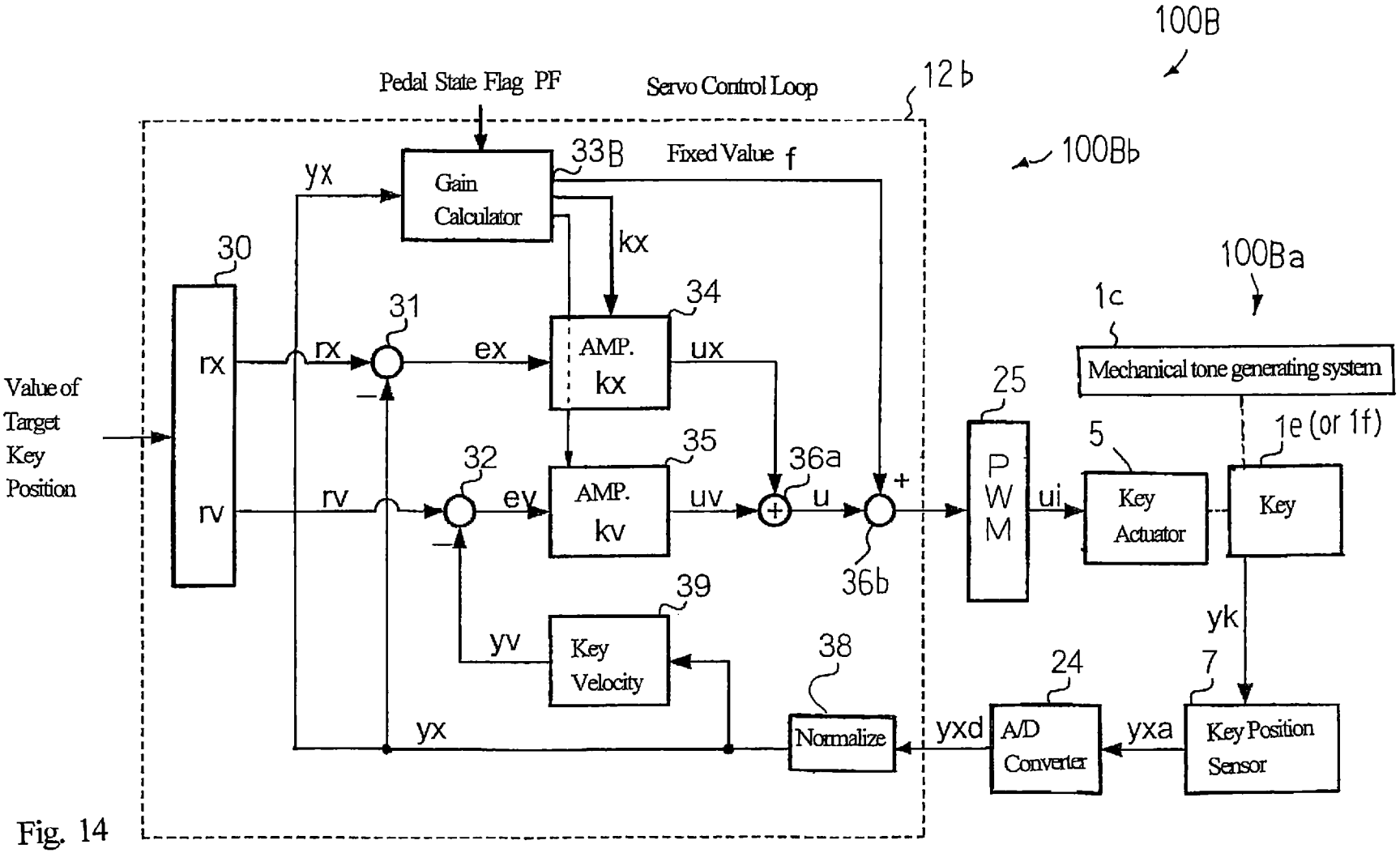
FIG. 14 is a block diagram showing a servo control loop created in yet another automatic player piano of the present invention.

Turning to FIG. 14 of the drawings, yet another automatic player piano 100B embodying the present invention largely comprises an upright piano 100Ba and an automatic playing system 100Bb.

The upright piano 100Ba is similar in structure to the upright piano 100*a* so that component parts of the upright piano 100Ba are labeled with references designating the corresponding component parts of the upright piano 100*a* without detailed description.

The automatic playing system 100Bb is similar in system configuration to the automatic playing system 100*b*, and, accordingly, system components of the automatic playing system 100Bb are labeled with references designating the corresponding system components of automatic playing system 100*b*. A computer program, which runs on the central processing unit 11*a* of the automatic playing system 100Bb, is same as the computer program in the automatic playing system 100*b* except for a part of the subroutine program for servo control. For this reason, description is focused on the part of subroutine program for servo control with reference to FIG. 14.

FIG. 14 shows a servo control loop realized through the execution of subroutine program for servo control. The functions of the servo control loop shown in FIG. 14 are same as those of the functions 30, 31, 32, 34, 35, 36*a*, 36*b*, 38 and 39 of servo control loop shown in FIG. 6 except for gain calculator 33B. For this reason, the other functions in the servo control loop shown in FIG. 14 are labeled with references designating the functions shown in FIG. 6 without detailed description.

The gain controller 33B is different from the gain controller 33 in that the numerical range is selected from the gain tables on the basis of the actual key position yx instead of the target key position rx. For this reason, a data line extends from the function block 38 for normalization to both of the function block 39 for the calculation of key velocity and gain controller 33B.

The servo control loop shown in FIG. 14 also achieves the advantages of the servo control loop shown in FIG. 6 by virtue of the gain tables selectively accessed in dependence on the pedal state of soft pedal 110*a*.

Fourth Embodiment

Figure 15:
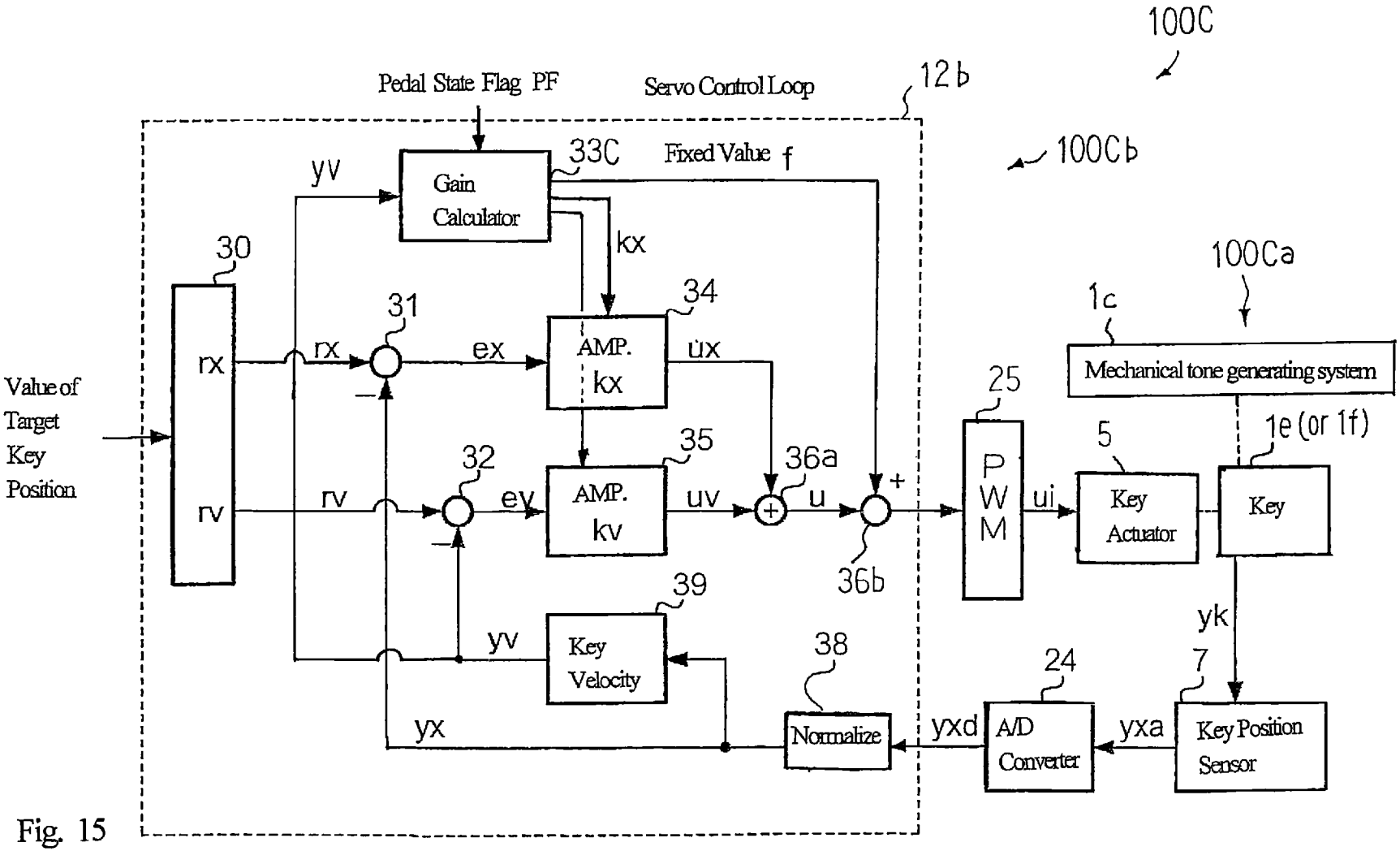
FIG. 15 is a block diagram showing a servo control loop created in still another automatic player piano of the present invention.

Turning to FIG. 15 of the drawings, still another automatic player piano 100C embodying the present invention largely comprises an upright piano 100Ca and an automatic playing system 100Cb.

The upright piano 100Ca is similar in structure to the upright piano 100*a* so that component parts of the upright piano 100Ca are labeled with references designating the corresponding component parts of the upright piano 100*a* without detailed description.

The automatic playing system 100Cb is similar in system configuration to the automatic playing system 100*b*, and, accordingly, system components of the automatic playing system 100Cb are labeled with references designating the corresponding system components of automatic playing system 100*b*. A computer program, which runs on the central processing unit 11*a* of the automatic playing system 100Cb, is same as the computer program in the automatic playing system 100*b* except for a part of the subroutine program for servo control. For this reason, description is focused on the part of subroutine program for servo control with reference to FIG. 15.

FIG. 15 shows a servo control loop realized through the execution of subroutine program for servo control. The functions of the servo control loop shown in FIG. 15 are same as those of the functions 30, 31, 32, 34, 35, 36*a*, 36*b*, 38 and 39 of servo control loop shown in FIG. 6 except for gain calculator 33C. For this reason, the other functions in the servo control loop shown in FIG. 15 are labeled with references designating the functions shown in FIG. 6 without detailed description.

The gain controller 33C is different from the gain controller 33 in that the numerical range is selected from the gain tables on the basis of the actual key position yx instead of the target key position rx. For this reason, a data line extends from the function block 39 for key velocity to both of the function block 32 for the addition and gain controller 33C. The gain controller 33C carries out integration on the values of key velocity yv, and selects one of the numerical ranges in the selected gain table. It is possible to determine the key velocity yv on the basis of values of key position yx through differentiation.

The servo control loop shown in FIG. 15 also achieves the advantages of the servo control loop shown in FIG. 6 by virtue of the gain tables selectively accessed in dependence on the pedal state of soft pedal 110*a*.

Fifth Embodiment

Figure 16:
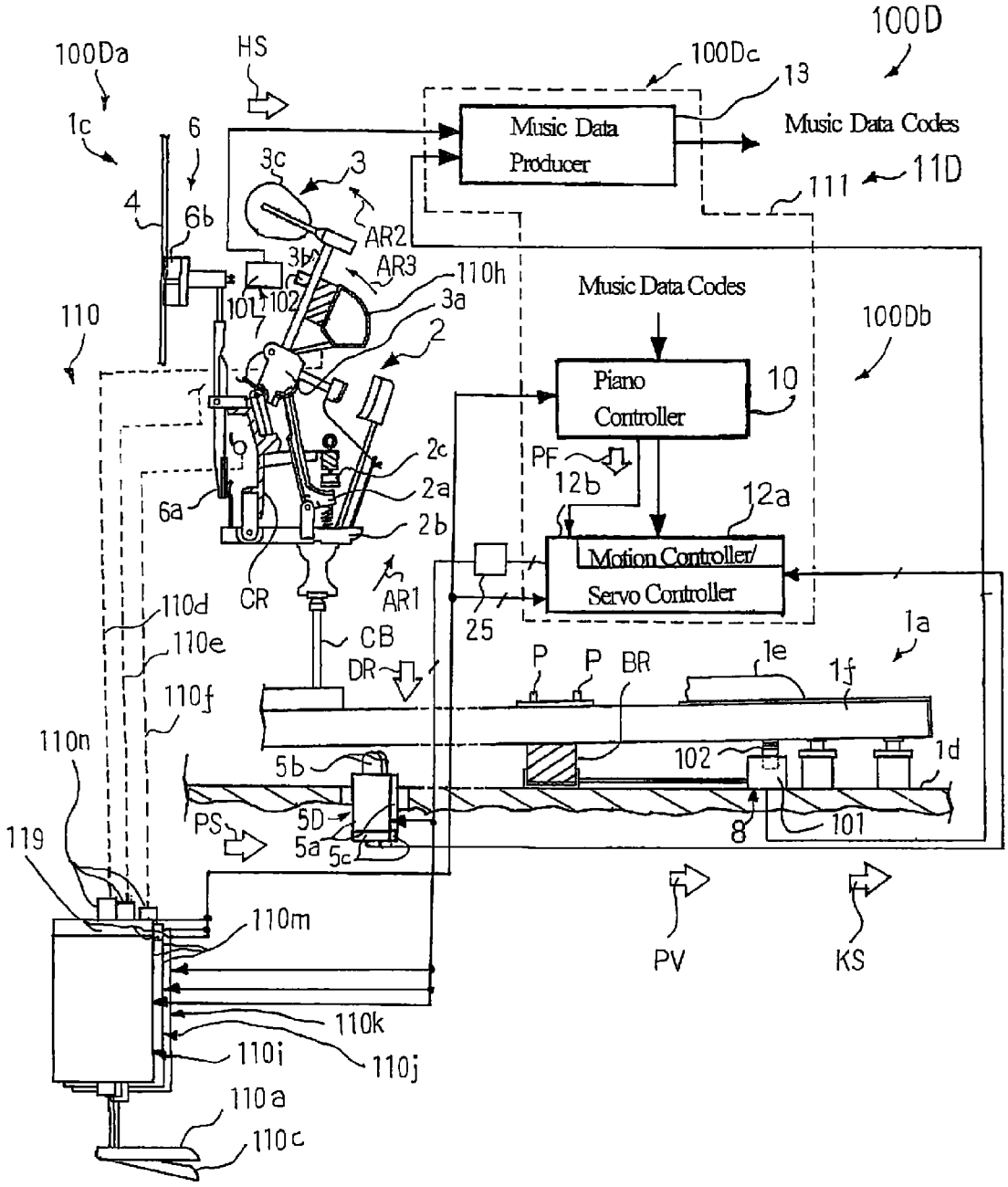
FIG. 16 is a cross sectional side view showing the structure of yet another automatic player piano of the present invention.

Turning to FIG. 16, yet another automatic player piano 100D largely comprises an upright piano 100Da, an automatic playing system 100Db and a recording system 100Dc. The upright piano 100Da and recording system 100Dc are similar in structure to the upright piano 100*a* and recording system 100*c*, and component parts of the upright piano 100Da and a software module of the recording system 100Dc are labeled with references designating corresponding component parts of upright piano 100*a* and software module of recording system 100*c* without detailed description.

The automatic playing system 100Db is different from the automatic playing system 100*b* in that the actual key velocity yv is input to the servo control loop. The key position signal KS is used in only the recording. In detail, the array of solenoid-operated key actuators 5 is replaced with an array of solenoid-operated key actuators 5D for the automatic playing system 100Db. Each of the solenoid-operated key actuators 5D includes a solenoid 5*a*, a plunger 5*b* and a built-in plunger sensor 5*c*. The solenoid and plunger are same as those of the solenoid-operated key actuator 5. The built-in plunger sensor 5*c* monitors the plunger 5*b*, and produces a plunger velocity signal PV representative of the plunger velocity. In this instance, the built-in plunger velocity sensor 5*c* is implemented by a stationary coil and a movable piece of permanent magnet. The piece of permanent magnet is moved inside the stationary coil together with the plunger 5*b*, and converts the plunger velocity to the electric current.

The analog plunger velocity signal PV is supplied to the signal interface of information processing system 111 of a controller 11D, which forms a part of the automatic playing system 100Db. The analog plunger velocity signal PV is subjected to an analog-to-digital conversion, and the discrete value of digital plunger velocity signal is periodically accumulated in the data table. The discrete value is normalized, and the normalized discrete value expresses an actual plunger velocity, which is equivalent to the actual key velocity, and an actual key position is determined on the basis of a series of values of actual key velocity through integration. The actual key position and actual key velocity are compared with the target key position rx and target key velocity rv so as to determine the position difference ex and velocity difference ev. The position difference ex and velocity difference ev are multiplied by the position gain kx and velocity gain kv, and the target duty ratio (u+f) is determined through the function blocks 36*a* and 36*b* as similar to that of the first embodiment. The position gain kx, velocity gain kv and fixed value f are supplied from the gain calculator 33 to the amplifiers 34 and 35 and adder 36*b*. The gain tables shown in FIGS. 7 and 8 are selectively accessed so that the advantages of first embodiment are obtained.

As will be appreciated from the foregoing description, the values of gain or gains in the pedal-on state are reduced from the values of gain or gains in the pedal-off state in accordance with the present invention. Even if the load of key actuators is reduced due to the gap created between the jacks and hammer butts under the pedal-on state, the key actuators gently move the associated keys until the jacks are brought into contact with the hammer butts so that the original key movements are reproduced in the automatic performance at high fidelity. The hammers are not brought into collision with the strings at unintentional large value of final hammer velocity.

Although particular embodiments of the present invention have been shown and described, it will be apparent to those skilled in the art that various changes and modifications may be made without departing from the spirit and scope of the present invention.

The upright piano does not set any limit on the technical scope of the present invention. The present invention can appertain to any sort of acoustic piano in so far as the hammers are slightly spaced from the action units rest in the original positions when the player presses down a pedal of the pedal mechanism for imparting an artificial expression to a music passage. A sort of electronic keyboard is equipped with action units and hammers, and the hammer stroke is varied with a pedal. The present invention may appertain to the electronic keyboard.

The automatic player piano of the present invention may further include a muting system and an electronic tone generating system. The muting system has a hammer stopper between the hammer assemblies and the strings, and the hammer stopper is changed between free position where the strings are struck with the hammers and a blocking position where the hammers rebound on the hammer stopper before reaching the strings. While the hammer stopper is staying at the blocking position, electronic tones are produced through the electronic tone generating system, and the action units, dampers and hammers give the unique piano key touch to the human player. In this instance, i.e., a muting piano, the reduction of position gain is also effective against the unstable key movements in the automatic performance on the condition that the hammer stopper stays at the blocking position.

The piano controller 10 is not an indispensable element of the present invention. The note event data codes and pedal event data codes may be timely supplied from a server computer outside the automatic player piano 100, 100A, 100B, 100C or 100D.

The key position sensors 8 and/or hammer position sensors 7 may be replaced with another sort of sensors such as, for example, key velocity sensors and/or hammer velocity sensors in so far as the sort of sensors convert a physical quantity expressing the movements of keys or the movements of hammers to detecting signals. In case where the key position sensors 8 and hammer position sensors 7 are replaced with the key velocity sensors and/or hammer velocity sensors, the actual key position and/or hammer position are calculated on the basis of values of key velocity and/or values of hammer velocity. A key acceleration sensor and/or a hammer acceleration sensor is available for an automatic player piano of the present invention.

The three pedals 110*a*, 110*b* and 110*c* do not set any limit to the technical scope of the present invention. The pedal system may have only the damper pedal and soft pedal.

The pedals 110*a*, 110*b* and 110*c* may not be servo controlled. In this instance, the pedals are simply depressed and released by solenoid-operated pedal actuators, and the built-in plunger sensors 110*p* are not provided in the solenoid-operated pedal actuators. The controller simply changes the solenoid-operated pedal actuators between the off state and the on state. In this instance, the soft pedal 110*a* is monitored with a pedal sensor, and the pedal sensor reports the current pedal state to the controller through a detecting signal. Otherwise, the position of hammer rail or the original positions of hammers may be reported from a suitable sensor to the information processing system 111. A state flag is raised and taken down depending upon the current pedal state, and the central processing unit 11*a* selects the optimum gain table depending upon the current pedal state. The pedal sensor, which monitors the soft pedal 110*a*, may be implemented by a reflection type photo coupler or a pressure sensitive plate.

A part of the software module 10, 12*a*, 12*b* and 13 may be implemented by a wired logic circuit. For example, the comparators 31 and 32 may be implemented by subtractors, and the amplifiers 34 and 35 may be implemented by multipliers.

The MIDI protocols do not set any limit to the technical scope of the present invention. Various music data protocols were proposed before the MIDI protocols and after the MIDI protocols.

In the above-described embodiments, the movements of keys 1*e* and 1*f* are expressed by the values of key position data and the values of key velocity data. However, the key position and key velocity, which are sorts of physical quantities, do not set any limit to the technical scope of the present invention. The movements of keys 1*e* and 1*f* may be expressed only one physical quantity or another combination of two or more than two sorts of physical quantity such as, the key position and acceleration of keys or the key position, key velocity and force on the keys 1*e* and 1*f*.

The units of physical quantities and the numerical range of values do not set any limit to the technical scope of the present invention. Proper units and numerical ranges are dependent on dimensions of component parts of piano and positions of sensors. The target key position may be expressed in centimeters, and the range of values rx may be longer than or shorter than 10 millimeters.

The values of gain tables shown in FIGS. 7 and 8 do not set any limit to the technical scope of the present invention. The gain table shown in FIGS. 7 and 8 are optimum for the upright piano 100*a* of the embodiment. If an upright piano has the hammers different in weight, solenoid-operated key actuators different in performance and keys different in stroke, gain tables are to be tailored for the upright piano.

The time intervals of servo control may be different from 1 millisecond, i.e., shorter than or longer than 1 millisecond. The time intervals of servo control are dependent on the system configuration and capability of the controller 11.

The data tables do not set any limit to the technical scope of the present invention. The position gain kx and velocity gain kv may be calculated as follows. For example, only the gain table shown in FIG. 8 is stored in the read only memory 11*b*, and decrements are prepared in the subroutine program for the servo control. If the pedal state flag PF is raised, the central processing unit 11*a* subtracts the decrement from the values in the gain table shown in FIG. 8. The position gain kx, velocity gain kv and fixed value f may be defined in the subroutine program for the servo control.

The computer program may be stored in a suitable information storage medium such as, for example, a magnetic tape cassette, a magnetic disk, a flexible disk, an optical disk and an opto-magnetic disk so as to be offered to users independently of the automatic player piano. Otherwise, the computer program may be downloaded from a suitable program server through a communication network such as, for example, the internet.

The hammer rail 110*h* is a typical example of the means for reducing the hammer stroke. However, the hammer rail 110*h* does not set any limit to the technical scope of the present invention. The strings may become close to the hammer assemblies at the original positions for reducing the hammer stroke.

The solenoid-operated key actuators 5 do not set any limit to the technical scope of the present invention. First, the whippen assemblies 2*b* may be directly driven for rotation by suitable solenoid-operated actuators. Second, the solenoid-operated key actuators 5 may be replaced with another sort of actuators such as, for example, pneumatic actuators, hydraulic actuators, motors, polymer or actuators.

The structure of action units 2, i.e., the combination of jack 2*a*, whippen assembly 2*b* and regulating button 2*c* does not set any limit to the technical scope of the present invention. The action unit is expected to convert the movements of keys to the rotation of hammers, and various sorts of action units have been proposed. Any one of the various sorts of action unit may be incorporated in an automatic player piano of the present invention as long as the movements of keys are converted to the rotation of hammers by means of the sort of action unit. An action unit has a leaf spring, and the leaf spring is elastically deformed by a key to give rise to rotation of a hammer at the recovery of the elastically deformed leaf spring.

The component parts of the above-described embodiments are correlated with claim languages as follows. Each of the automatic player pianos 100, 100A, 100B, 100C and 100D is corresponding to an "automatic player musical instrument". The upright piano 100*a*, 100Aa, 100Ba, 100Ca or 100Da serves as a "keyboard musical instrument", and the automatic playing system 100*b*, 100Ab, 100Bb, 100Cb or 100Db is corresponding to an "automatic playing system." The music data codes or MIDI music data codes are corresponding to "music data codes", and the reduction in loudness of tones is "a music effect."

The keyboard 1*a* is corresponding to a "keyboard", and the black keys 1*e* and white keys 1*f* serve as "plural keys." The mechanical tone generating system 1*c* or the electronic tone generating system of muting piano/electronic keyboard serves as "a tone generating system", and the keys 1*e* and 1*f*, action units 2 and hammers 3 form in combination plural force transmitting paths. Each of the action units 2 serves as "an action unit", and each of the hammer assemblies 3 is corresponding to "a hammer".

The soft pedal 110*a*, soft pedal system 110*d*, from which the hammer rail 110*h* is eliminated, and hammer rail 110*h* form in combination "at least one pedal system", and the soft pedal 110*a* and the soft pedal linkwork 110*d* corresponding to "at least one pedal" and "a pedal linkwork", respectively. The hammer rail 110*h* serves as a "stroke changer."

The solenoid-operated key actuators 5 are corresponding to "plural actuators", and the driving signals DR serve as "driving signals." The duty ratio or the amount of mean current is equivalent to "magnitude". The key position sensors 8 are corresponding to "plural key sensors", and the key position signals KS serve as "detecting signals." The actual key position is "physical quantity", and the values of actual key positions are "actual values of physical quantity."

The motion controller 12 for determining the reference pedal trajectories, servo controller 12*b*, pulse width modulator 25 and solenoid-operated pedal actuator 110*i* with built-in plunger sensor 119 as a whole constitute a "pedal controller", and the built-in plunger sensor 119, signal interface for the built-in plunger sensor 119, information processing system 111 and pedal state flag PF form in combination "at least one pedal state detector."

The pulse width modulator 25 serves as a "signal regulator", and the motion controller 12*a* and servo controller 12*b*, which are operative for the keys 1*e* and 1*f*, are corresponding to a "motion controller" and a "servo controller", respectively. The function block 30, 31, 32, 38 and 39 form in combination a "comparator", and the function blocks 34, 35A, 36*a* and 36*b* form in combination a "magnitude determiner." The function block 33A serves as a "gain controller."

The movement of each key which the solenoid-operated key actuator 5 gives rise to is a "real movement", and the movement which is expressed by the reference forward key trajectory is an "expected movement. The values shown in FIG. 8 are "non-reduced value", and the values shown in FIG. 7 are "reduced value."

While the target key position kx is fallen within the range from zero to 4 millimeters, the range from zero to 4 millimeters is equivalent to "initial stages of the movements of plural force transmitting paths." The range greater than 4 millimeters is equivalent to "stages after said initial stages." In the embodiments, a "predetermined value" of key stroke is 4 millimeters, and a "value of gap" is 3 millimeters.

What is claimed is:

1. An automatic player musical instrument for reproducing tones along a music passage on the basis of music data codes expressing said tones to be produced and a music effect to be imparted to said tones, comprising:

a keyboard musical instrument including plural keys selectively moved for specifying pitch names of said tones to be produced, a tone generating system connected to said plural keys for producing said tones at said pitch names, and forming parts of plural force transmitting paths, each of said plural force transmitting paths having one of said plural keys, an action unit connected to said one of said plural keys for transmitting force therethrough and a hammer driven by said action unit for flying over a hammer stroke, and a pedal system having at least one pedal moved between pedal-on state for imparting said music effect to said tones and pedal-off state for eliminating said music effect from said tones, a stroke changer activated so as to change said hammer stroke from a previous value to another value and deactivated so as to change said hammer stroke from said another value to said previous value, a pedal linkwork connected between said at least one pedal and said stroke changer, and transmitting a movement of said at least one pedal to said stroke changer for changing said stroke changer between the activation and the deactivation; and an automatic playing system including plural actuators respectively provided for said plural force transmitting paths, and converting driving signals to force exerted on said force transmitting paths so as to give rise to movements of said force transmitting paths, plural key sensors respectively monitoring said plural force transmitting paths and producing detecting signals representative of actual values of physical quantity expressing said movements of said plural force transmitting paths, a pedal controller analyzing said music data codes expressing said music effect and changing said at least one pedal between said pedal-on state and said pedal-off state depending upon results of analysis on said music data codes expressing said music effect, at least one pedal state detector monitoring said at least one pedal so as to determine pedal state expressing whether said at least one pedal stays in said pedal-on state or said pedal-off state, a signal regulator connected to said plural actuators and adjusting said driving signals to target values of a magnitude, a motion controller sequentially supplied with said music data codes expressing said tones and determining target values of said physical quantity for said keys, and a servo controller connected to said plural sensors for receiving said actual values of said physical quantity, said at least one pedal state detector for receiving said pedal state, said motion controller for receiving said target values of said physical quantity and said signal regulator for supplying pieces of control data expressing said target values of said magnitude, and having a comparator comparing each of said target values of said physical quantity with one of said actual values of said physical quantity corresponding to said each of said target values so as to determine a difference between said each of said target values and said one of said actual values, a magnitude determiner connected between said comparator and said signal regulator and determining said target values of magnitude through a multiplication between said difference and a value of gain for supplying said pieces of control data to said signal regulator, and a gain controller connected between said pedal state detector and said magnitude determiner and reducing said value of gain when said at least one pedal is in said pedal-on state.

2. The automatic player musical instrument as set forth in claim 1, in which said gain controller reduces said value of gain in initial stages of said movements of said plural force transmitting paths in the pedal-on state, and recovers said gain to a value previous to the reduction of said value of said gain in stages of said movements after said initial stages.

3. The automatic player musical instrument as set forth in claim 2, in which said initial stages are defined as key strokes from zero to a predetermined value.

4. The automatic player musical instrument as set forth in claim 3, in which said predetermined value is greater than a value of gap between said action units and said hammers in said pedal-on state and is less than twice of said value of said gap.

5. The automatic player musical instrument as set forth in claim 1, in which said physical quantity is indicative of at least position from rest positions of said plural keys.

6. The automatic player musical instrument as set forth in claim 5, in which said physical quantity is further indicative of velocity of said plural keys so that said difference expresses a position difference and a velocity difference.

7. The automatic player musical instrument as set forth in claim 6, in which said gain includes a position gain and a velocity gain so that said position difference and said velocity difference are respectively multiplied by said position gain and said velocity gain, and said target value of said magnitude is determined through an addition of the product between said position difference and said position gain, the product between said velocity difference and said velocity gain and a fixed value.

8. The automatic player musical instrument as set forth in claim 1, in which said keyboard musical instrument is an upright piano having a soft pedal serving as at least one pedal, and said stroke changer is a hammer rail moved from an original position toward strings to be struck with said hammers by a certain distance and returning to said original position.

9. The automatic player musical instrument as set forth in claim 8, in which said plural actuators are respectively provided for said plural keys so as to exert said force on said plural keys, and the movements of said plural keys are converted through movements of said action units to rotation of said hammers toward said strings, whereby said hammers are brought into collision with said strings at end of said rotation for producing said tones through vibrations of said strings.

10. An automatic playing system provided for an automatic performance expressed by music data codes on a keyboard musical instrument having plural force transmitting paths for producing tones and a pedal system for giving a music effect to said tones through change of a hammer stroke, comprising:

plural actuators respectively provided for said plural force transmitting paths each having a key moved for specifying one of said tones, an action unit transmitting force therethrough and a hammer driven by said action unit for flying over said hammer stroke, and converting driving signals to said force exerted on said force transmitting paths so as to give rise to movements of said force transmitting paths, plural key sensors respectively monitoring said plural force transmitting paths and producing detecting signals representative of actual values of physical quantity expressing said movements of said plural force transmitting paths, a pedal controller analyzing the music data codes expressing said music effect and changing at least one pedal of said pedal system between said pedal-on state for giving said music effect to said tones and said pedal-off state for removing said music effect from said tones depending upon results of analysis on said music data codes expressing said music effect, at least one pedal state detector monitoring said at least one pedal so as to determine pedal state expressing whether said at least one pedal stays in said pedal-on state or said pedal-off state, a signal regulator connected to said plural actuators and adjusting said driving signals to target values of a magnitude, a motion controller sequentially supplied with said music data codes and determining target values of said physical quantity for said keys, and a servo controller connected to said plural sensors for receiving said actual values of said physical quantity, said at least one pedal state detector for receiving said pedal state, said motion controller for receiving said target values of said physical quantity and said signal regulator for supplying pieces of control data expressing said target values of said magnitude, and having a comparator comparing each of said target values of said physical quantity with one of said actual values of said physical quantity corresponding to said each of said target values so as to determine a difference between said each of said target values and said one of said actual values, a magnitude determiner connected between said comparator and said signal regulator and determining said target values of magnitude through a multiplication between said difference and a value of gain for supplying said pieces of control data to said signal regulator, and a gain controller connected between said pedal state detector and said magnitude determiner and reducing said value of gain when said at least one pedal is in said pedal-on state.

11. The automatic playing system as set forth in claim 10, in which said gain controller reduces said value of gain in initial stages of said movements of said plural force transmitting paths in the pedal-on state, and recovers said gain to a value previous to the reduction of said value of said gain in stages of said movements after said initial stages.

12. The automatic playing system as set forth in claim 11, in which said initial stages are defined as key strokes of the keys from zero to a predetermined value.

13. The automatic playing system as set forth in claim 12, in which said predetermined value is greater than a value of gap between the action units and the hammers in said pedal-on state and is less than twice of said value of said gap.

14. The automatic playing system as set forth in claim 10, in which said physical quantity is indicative of at least position from rest positions of said keys.

15. The automatic playing system as set forth in claim 14, in which said physical quantity is further indicative of velocity of said keys so that said difference expresses a position difference and a velocity difference.

16. The automatic playing system as set forth in claim 15, in which said gain includes a position gain and a velocity gain so that said position difference and said velocity difference are respectively multiplied by said position gain and said velocity gain, and said target value of said magnitude is determined through an addition of the product between said position difference and said position gain, the product between said velocity difference and said velocity gain and a fixed value.

17. The automatic playing system as set forth in claim 10, in which said keyboard musical instrument is an upright piano having a soft pedal serving as at least one pedal, and said stroke changer is a hammer rail moved from an original position toward strings to be struck with the hammers by a certain distance and returning to said original position.

18. The automatic playing system as set forth in claim 17, in which said plural actuators are respectively provided for the keys so as to exert said force on said keys, and the movements of said keys are converted through movements of said action units to rotation of said hammers toward said strings, whereby said hammers are brought into collision with said strings at end of said rotation for producing said tones through vibrations of said strings.

19. A method controlling an automatic player musical instrument for an automatic performance, comprising the steps of:

a) acquiring an actual value of physical quantity expressing a real movement of a key of a keyboard musical instrument for producing a tone, a target value of said physical quantity expressing an expected movement of said key and a piece of state data expressing whether or not a pedal for imparting a music effect to said tones is changed between pedal-on state and pedal-off state;

b) determining whether a gain is to have a reduced value or a non-reduced value on the basis of said piece of state data and said physical quantity and a difference between said actual value of said physical quantity and said target value of said physical quantity;

c) determining a target value of a magnitude of a driving signal through a multiplication between said difference and one of said reduced value and non-reduced value;

d) adjusting said driving signal to said target value of said magnitude;

e) supplying said driving signal to an actuator provided for said key so as to give rise to said real movement; and f) repeating said steps a) to e) until said key completes said real movements.

20. The method as set forth in claim 19, in which said step c) includes the sub-steps of c-1) multiplying a position difference serving as a first sort of said difference and a velocity difference serving as a second sort of said difference by a position gain serving as a first sort of said gain and a velocity gain serving as a second sort of said gain, respectively, c-2) adding the product between said position difference and said position gain, the product between said velocity difference and said velocity gain and a fixed value so as to determine the sum of said products and said fixed value, and c-3) determining said sum as said target value of said magnitude.

* * * * *